US011024258B2

(12) United States Patent
Jeong et al.

(10) Patent No.: US 11,024,258 B2
(45) Date of Patent: Jun. 1, 2021

(54) DISPLAY DEVICE CAPABLE OF DISPLAYING AN IMAGE OF UNIFORM BRIGHTNESS

(71) Applicant: Samsung Display Co., Ltd., Yongin-si (KR)

(72) Inventors: Jin Tae Jeong, Yongin-si (KR); Tae Hoon Kwon, Yongin-si (KR); Min Ku Lee, Yongin-si (KR); Ji Hyun Ka, Yongin-si (KR); Seung Kyu Lee, Yongin-si (KR); Seung Ji Cha, Yongin-si (KR)

(73) Assignee: Samsung Display Co., Ltd.

( * ) Notice: Subject to any disclaimer, the term of this patent is extended or adjusted under 35 U.S.C. 154(b) by 52 days.

(21) Appl. No.: 15/587,192

(22) Filed: May 4, 2017

(65) Prior Publication Data

US 2017/0352328 A1 Dec. 7, 2017

(30) Foreign Application Priority Data

Jun. 1, 2016 (KR) ..... 10-2016-0068361

(51) Int. Cl.
*G09G 5/10* (2006.01)
*G09G 3/3266* (2016.01)
(Continued)

(52) U.S. Cl.
CPC ..... *G09G 5/10* (2013.01); *G09G 3/3266* (2013.01); *G09G 3/3283* (2013.01);
(Continued)

(58) Field of Classification Search
None
See application file for complete search history.

(56) References Cited

U.S. PATENT DOCUMENTS 7,385,598 B2 6/2008 Jung et al.
8,638,280 B2 1/2014 Nonaka
(Continued)

FOREIGN PATENT DOCUMENTS

EP 3246911 A1 11/2017
JP 2003-323164 A 11/2003
(Continued)

OTHER PUBLICATIONS

Extended European Search Report corresponding to European Patent Application No. 17174077.2, dated Nov. 9, 2017, 10 pages.
(Continued)

*Primary Examiner* — Chad M Dicke
(74) *Attorney, Agent, or Firm* — Innovation Counsel LLP

(57) ABSTRACT

The present disclosure relates to a display device including first pixels disposed in a first pixel area, and connected to first scan lines; second pixels disposed in a second pixel area, and connected to second scan lines; a timing controller configured to supply a first clock signal and a second clock signal to a first clock line and a second clock line, respectively; a first scan driver configured to receive the first clock signal through the first clock line, and to supply a first scan signal to the first scan lines; and a second scan driver configured to receive the second clock signal through the second clock line, and to supply a second scan signal to the second scan lines, wherein the second pixel area has a smaller width than the first pixel area.

9 Claims, 17 Drawing Sheets

(51) Int. Cl.
*G09G 3/3283* (2016.01)
*G09G 3/36* (2006.01)

(52) U.S. Cl.
CPC ... *G09G 3/3677* (2013.01); *G09G 2310/0286* (2013.01); *G09G 2310/066* (2013.01); *G09G 2310/08* (2013.01); *G09G 2320/0223* (2013.01); *G09G 2320/0233* (2013.01); *G09G 2320/064* (2013.01)

(56) References Cited

U.S. PATENT DOCUMENTS 10,019,949 B2 * 7/2018 Ma ..... G11C 19/184
10,109,250 B2 * 10/2018 Wang ..... G11C 19/184
10,115,366 B2 * 10/2018 Choi ..... G09G 3/3696
10,157,683 B2 * 12/2018 Jang ..... G09G 3/20
10,181,279 B2 * 1/2019 Shim ..... G09G 3/2092
10,229,646 B2 * 3/2019 Wu ..... G09G 3/3677
10,242,638 B2 * 3/2019 Liang ..... G09G 3/3677
10,255,861 B2 * 4/2019 Chen ..... G09G 3/3677
10,268,293 B2 * 4/2019 Hsu ..... G09G 3/3677
10,338,727 B2 * 7/2019 Yu ..... G06F 3/044
10,490,128 B1 * 11/2019 Qian ..... G09G 3/3266
2003/0210215 A1 11/2003 Takahashi
2005/0057477 A1 * 3/2005 Yun ..... G02F 1/13452 345/93
2006/0077191 A1 * 4/2006 Ming-Daw ..... G02F 1/133351 345/204
2006/0119560 A1 6/2006 Jeon
2006/0244387 A1 * 11/2006 Park ..... G09G 3/3233 315/169.1
2007/0229433 A1 10/2007 Jang
2008/0088568 A1 * 4/2008 Haga ..... G09G 3/18 345/100
2008/0278467 A1 * 11/2008 Hwang ..... G09G 3/3648 345/205
2009/0115795 A1 5/2009 Pae et al.
2009/0262051 A1 * 10/2009 Kim ..... G09G 3/3266 345/80
2010/0085348 A1 * 4/2010 Bae ..... G09G 3/3648 345/213
2010/0123708 A1 5/2010 Jang et al.
2010/0321372 A1 * 12/2010 Iwamoto ..... G09G 3/3677 345/212
2012/0112988 A1 * 5/2012 Nakanishi ..... G02F 1/134309 345/76
2012/0113070 A1 * 5/2012 Wang ..... G09G 3/3677 345/204
2012/0212517 A1 * 8/2012 Ahn ..... G11C 19/28 345/690
2014/0176407 A1 6/2014 Choi et al.
2014/0253419 A1 9/2014 Tanada
2014/0347405 A1 * 11/2014 Kumeta ..... G09G 5/10 345/690
2016/0005346 A1 1/2016 Kim
2016/0111040 A1 * 4/2016 Kim ..... G02F 1/13454 345/698
2017/0061922 A1 * 3/2017 Wang ..... G11C 19/184
2017/0116923 A1 * 4/2017 Bae ..... G09G 3/2085
2017/0154572 A1 * 6/2017 Kim ..... G09G 3/3233
2017/0195658 A1 * 7/2017 Jung ..... G09G 3/3258
2018/0174531 A1 * 6/2018 Chen ..... G09G 3/3648
2018/0204889 A1 * 7/2018 Yu ..... G09G 3/3233

FOREIGN PATENT DOCUMENTS

JP 2006-166395 A 6/2006
JP 2007-251504 A 8/2007
JP 2008-292995 A 12/2008
JP 2011-39559 A 2/2011
JP 2014-197179 A 10/2014
JP 2015-014793 A 1/2015
KR 10-1281681 B1 7/2013
WO 2017/172375 A1 10/2017

OTHER PUBLICATIONS

European Communication corresponding to European Patent Application No. 17174077.2 dated Jul. 25, 2018.
EPO-Office Action Report, Application No. 17174077.2, dated Apr. 1, 2019, 16 pages.

* cited by examiner

DISPLAY DEVICE CAPABLE OF DISPLAYING AN IMAGE OF UNIFORM BRIGHTNESS

CROSS-REFERENCE TO RELATED APPLICATION

This application claims priority to and the benefit of Korea Patent Application No. 10-2016-0068361, filed on Jun. 1, 2016, in the Korean Intellectual Property office, the entire contents of which are incorporated herein by reference in their entirety.

BACKGROUND

Field

Embodiments of the present disclosure relate to a display device.

Description of Related Art

With the development of the informatization technology, the importance of a display device that is a medium connecting users and information is being emphasized. Recently, liquid crystal display devices, organic light emitting display devices and the like are widely being used.

Such display devices may include a plurality of pixels for displaying images, the pixels may be connected to driving wires.

Here, loads of the driving wires may differ depending on the locations of the driving wires.

SUMMARY

A purpose of the present disclosure is to resolve the aforementioned problem, that is, to provide a display device capable of displaying an image of uniform brightness.

According to an embodiment of the present disclosure, there is provided a display device including first pixels disposed in a first pixel area, and connected to first scan lines; second pixels disposed in a second pixel area, and connected to second scan lines; a timing controller configured to supply a first clock signal and a second clock signal to a first clock line and a second clock line, respectively; a first scan driver configured to receive the first clock signal through the first clock line, and to supply a first scan signal to the first scan lines; and a second scan driver configured to receive the second clock signal through the second clock line, and to supply a second scan signal to the second scan lines, wherein the second pixel area has a smaller width than the first pixel area.

Further, the first clock signal and the second clock signal may have a different signal characteristic.

Further, the signal characteristic may include at least one of a pulse width, a length of a rising edge period and a length of a falling edge period.

Further, the pulse width of the second clock signal may be set to be smaller than the pulse width of the first clock signal.

Further, the rising edge period of the second clock signal may be set to be longer than the rising edge period of the first clock signal.

Further, the second clock signal may have a staircase wave form and the second clock signal may change from a low voltage to a high voltage via an intermediate voltage during the rising edge period.

Further, the falling edge period of the second clock signal may be set to be longer than the falling edge period of the first clock signal.

Further, the second clock signal may have a staircase wave form and the second clock signal may change from a high voltage to a low voltage via an intermediate voltage during the falling edge period.

Further, the second pixel area may have a shorter length than the first pixel area.

Further, lengths of the second scan lines may be shorter than lengths of the first scan lines.

Further, the number of the second pixels may be smaller than the number of the first pixels.

Further, the display device may further include third pixels disposed in a third pixel area having a smaller width than the first pixel area, and connected to third scan lines; and a third scan driver configured to receive a third clock signal through a third clock line, and to supply a third scan signal to the third scan lines.

Further, the timing controller may further supply the third clock signal to the third clock line.

Further, the first clock signal and the third clock signal may have a different signal characteristic.

Further, the signal characteristic may include at least one of a pulse width, a length of a rising edge period and a length of a falling edge period.

Further, the pulse width of the third clock signal may be set to be smaller than the pulse width of the first clock signal.

Further, the rising edge period of the third clock signal may be set to be longer than the rising edge period of the first clock signal.

Further, the third clock signal has a staircase wave form and the third clock signal may change from a low voltage to a high voltage via an intermediate voltage during the rising edge period.

Further, the falling edge period of the third clock signal may be set to be longer than the falling edge period of the first clock signal.

Further, the third clock signal has a staircase wave form and third clock signal may change from a high voltage to a low voltage via an intermediate voltage during the falling edge period.

Further, the third pixel area may have a shorter length than the first pixel area.

Further, lengths of the third scan lines may be shorter than lengths of the first scan lines.

Further, the number of the third pixels may be smaller than the number of the first pixels.

Further, the second pixel area may be disposed between the first pixel area and the third pixel area.

Further, the third pixel area may be spaced apart from the second pixel area.

According to another embodiment of the present disclosure, there is provided a display device including first pixels disposed in a first pixel area, and connected to first scan lines; second pixels disposed in a second pixel area, and connected to second scan lines; third pixels disposed in a third pixel area, and connected to third scan lines; a timing controller configured to supply a first clock signal, a second clock signal, and a third clock signal to a first clock line, a second clock line, and a third clock line, respectively; a first scan driver configured to generate a first scan signal using the first clock signal, and to supply the first scan signal to the first scan lines; a second scan driver configured to generate a second scan signal using the second clock signal, and to supply the second scan signal to the second scan lines; and a third scan driver configured to generate a third scan signal using the third clock signal, and to supply the third scan signal to the third scan lines, wherein the first pixel area, the second pixel area, and the third pixel area has a width different from one another.

Further, the first clock signal, the second clock signal, and the third clock signal may have a signal characteristic different from one another.

Further, the signal characteristic may include at least one of a pulse width, a length of a rising edge period and a length of a falling edge period.

According to another embodiment of the present disclosure, there is provided a display device including a display panel including a first display area having a first scan line to which a first number of pixels are connected and a second display area having a second scan line to which a second number of pixels are connected, the second number being smaller than the first number; and a controller providing a first scan control signal and a second scan control signal to a first scan driver connected to the first scan line and a second scan driver connected to the second scan line, respectively, wherein the first scan driver and the second scan driver provide a first clock signal and the second clock signal to the first scan line and the second scan line, respectively, and wherein the first clock signal and the second clock signal have a different signal characteristic.

Further, the different signal characteristic may include at least one of a pulse width, a length of a rising edge period and a length of a falling edge period.

Further, the pulse width of the first clock signal may be greater than that of the second clock signal.

The length of the rising edge period of the second clock signal may be greater than that of the first clock signal.

The length of the falling edge period of the second clock signal may be greater than that of the first clock signal.

According to the present disclosure as mentioned above, it is possible to provide a display device capable of displaying an image of uniform brightness by reducing a difference of brightness occurring between a plurality of pixel areas.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present between the two elements. Like reference numerals refer to like elements throughout.

DETAILED DESCRIPTION

Figure 1A:
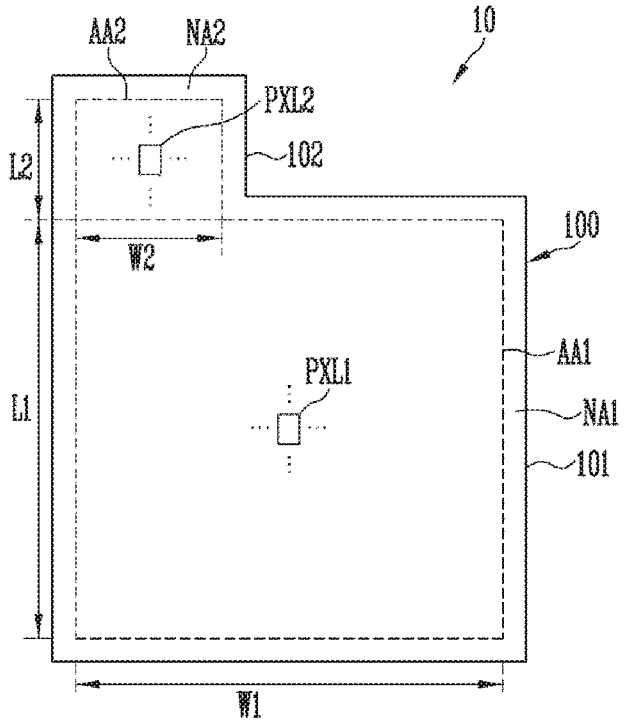
FIG. 1A and FIG. 1B are views each illustrating a pixel area of a display device according to an embodiment of the present disclosure.

Specific matters of other embodiments are included in the detailed description and the drawings.

Hereinafter, embodiments will be described in greater detail with reference to the accompanying drawings. Embodiments are described herein with reference to cross-sectional illustrations that are schematic illustrations of embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but may include deviations in shapes that result, for example, from manufacturing. In the drawings, lengths and sizes of layers and regions may be exaggerated for clarity. Like reference numerals in the drawings denote like elements. It is also noted that in this specification, "connected/coupled" refers to one component not only directly coupling another component but also indirectly coupling another component through an intermediate component. On the other hand, "directly connected/directly coupled" refers to one component directly coupling another component without an intermediate component.

Hereinafter, a display device according to an embodiment of the present disclosure will be explained with reference to the drawings related to the embodiments of the present disclosure.

Figure 1B:
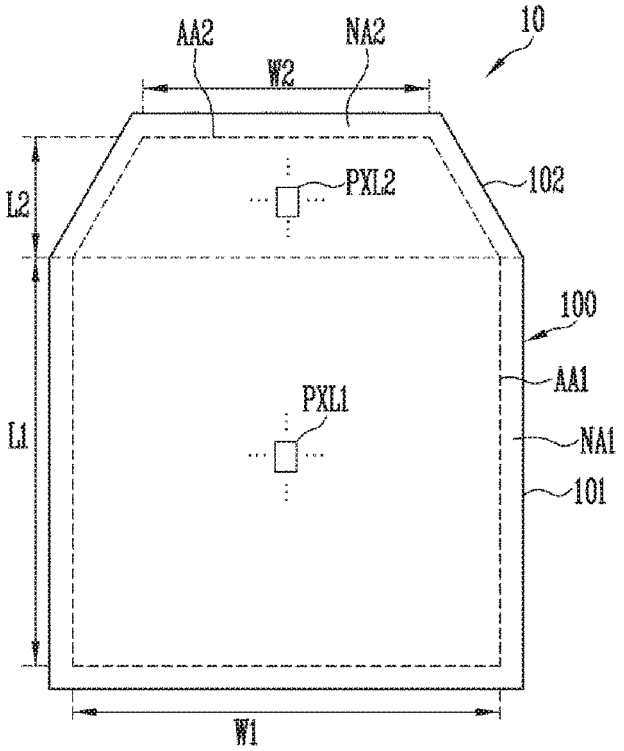

FIG. 1A and FIG. 1B are views each illustrating a pixel area of the display device according to an embodiment of the present disclosure.

Referring to FIG. 1A, the display device 10 according to the embodiment of the present disclosure may include pixel areas AA1, AA2 and peripheral areas NA1, NA2.

In the pixel areas AA1, AA2, a plurality of pixels PXL1, PXL2 are disposed, and accordingly, a certain image may be displayed on the pixel areas AA1, AA2. Therefore, the pixel areas AA1, AA2 may be called display areas.

In the peripheral areas NA1, NA2, elements for driving the pixels PXL1, PXL2 (for example, driver and wire, etc.) may be disposed. Since there are no pixels PXL1, PXL2 in the peripheral areas NA1, NA2, the peripheral areas NA1, NA2 may be called as non-display areas.

For example, the peripheral areas NA1, NA2 may exist outside the pixel areas AA1, AA2, and may surround at least a portion of the pixel areas AA1, AA2.

The pixel areas AA1, AA2 may include a first pixel area AA1, and a second pixel area AA2.

The second pixel area AA2 may be disposed at one side of the first pixel area AA1, and may have a smaller surface area than the first pixel area AA1.

For example, a width W2 of the second pixel area AA2 may be set to be smaller than a width W1 of the first pixel area AA1, and a length L2 of the second pixel area AA2 may be set to be shorter than a length L1 of the first pixel area AA1.

The peripheral areas NA1, NA2 may include a first peripheral area NA1 and a second peripheral area NA2.

The first peripheral area NA1 may exist on a periphery of the first pixel area AA1, and may surround at least a portion of the first pixel area AA1.

A width of the first peripheral area NA1 may be set to be the same overall. However, there is no limitation thereto, and thus the width of the first peripheral area NA1 may be set to differ depending on the location of the first peripheral area NA1.

The second peripheral area NA2 may exist on a periphery of the second pixel area AA2, and may surround at least a portion of the second pixel area AA2.

A width of the second peripheral area NA2 may be set to be the same overall. However, there is no limitation thereto, and thus the width of the second peripheral area NA2 may be set to differ depending on the location of the second peripheral area NA2.

The pixels PXL1, PXL2 may include first pixels PXL1 and second pixels PXL2.

For example, the first pixels PXL1 may be disposed in the first pixel area AA1, and the second pixels PXL2 may be disposed in the second pixel area AA2.

The pixels PXL1, PXL2 may emit light of a predetermined brightness according to a control by a driver, and for this purpose, the pixels PXL1, PXL2 may include a light emitting element (for example, organic light emitting diode).

The pixel areas AA1, AA2 and the peripheral areas NA1, NA2 may be disposed on a substrate 100 of the display device 10.

The substrate 100 may be formed in various shapes such that the pixel areas AA1, AA2 and the peripheral areas NA1, NA2 may be formed thereon.

For example, the substrate 100 may include a plate type base substrate 101, and a subsidiary substrate 102 that protruded from one end of the base substrate 101.

Here, the subsidiary substrate 102 may have a smaller surface area than the base substrate 101. For example, a width of the subsidiary substrate 102 may be set to be smaller than a width of the base substrate 101, and a length of the subsidiary substrate 102 may be set to be shorter than a length of the base substrate 101.

The subsidiary substrate 102 may have the same or similar shape as the second pixel area AA2, but without limitation, and thus may have a shape different from the second pixel area AA2.

The substrate 100 may be made of an insulating material such as glass and resin, etc. Further, the substrate 100 may be made of a material having flexibility such that it may be bent or curved, and may have a single-layered or multi-layered structure.

For example, the substrate 100 may include at least one of polystyrene, polyvinyl alcohol, polymethyl methacrylate, polyethersulfone, polyacrylate, polyetherimide, polyethylene naphthalate, polyethylene terephthalate, polyphenylene sulfide, polyarylate, polyimide, polycarbonate, triacetate cellulose, and cellulose acetate propionate.

However, the substrate 100 may be made of various other materials as well, for example, fiber glass reinforced plastic (FRP) and the like.

The second pixel area AA2 may have various shapes. For example, the second pixel area AA2 may have a polygonal shape, circular shape and the like. Further, at least a portion of the second pixel area AA2 may have a curve shape.

For example, the second pixel area AA2 may have a rectangular shape as illustrated in FIG. 1A.

Further, referring to FIG. 1B, the second pixel area AA2 may have a trapezoid shape where a long parallel side of the trapezoid are connected to the first pixel area AA1.

In accordance with the change of shape of the second pixel area AA2, the number of the second pixels PXL2 disposed in one row may differ depending on its location.

In the case of the second pixel area AA2 illustrated in FIG. 1B, the number of the second pixels PXL2 disposed in the one row may vary depend on the location in the second pixel area AA2. For example, the closer the one row is to the first pixel area AA1, the more second pixels PXL2 may be disposed in the one row.

Figure 2:
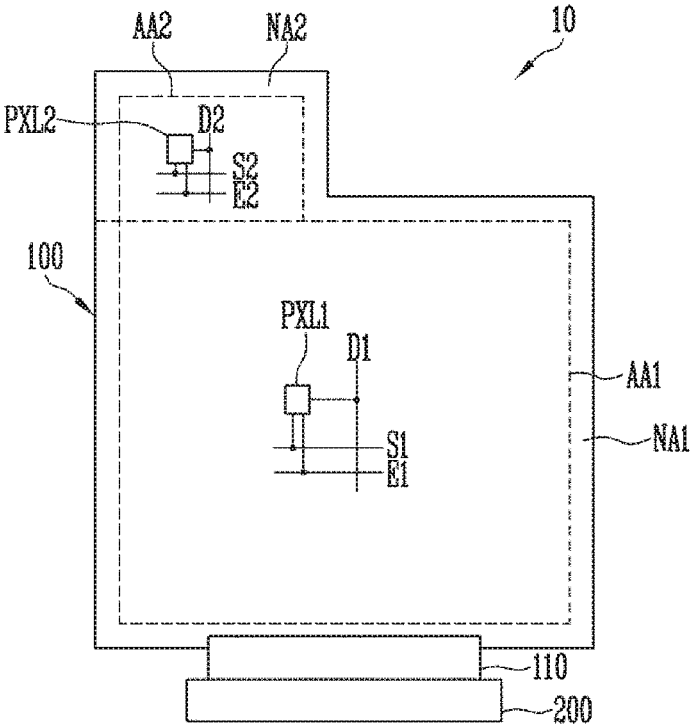
FIG. 2 is a view illustrating a display device according to an embodiment of the present disclosure.

FIG. 2 is a view illustrating a display device according to an embodiment of the present disclosure. The display device 10 illustrated in FIG. 2 is based on the pixel areas AA1, AA2 illustrated in FIG. 1A, but it may be applied to pixel areas AA1, AA2 having different shapes as those illustrated in FIG. 1B.

Referring to FIG. 2, the display device 10 according to the embodiment of the present disclosure may include first pixels PXL1, second pixels PXL2, and a display driver 200.

The first pixels PXL1 may be disposed in the first pixel area AA1. Each of the first pixels PXL1 may be connected to a first scan line S1, a first emission control line E1, and a first data line D1, respectively.

The second pixels PXL2 may be disposed in the second pixel area AA2. Each of the second pixels PXL2 may be connected to a respective second scan line S2, a second emission control line E2, and a second data line D2, respectively.

When necessary, the pixels PXL1, PXL2 may be connected to a plurality of scan lines.

The display driver 200 may control the emission of the pixels PXL1, PXL2 by supplying driving signals to the pixels PXL1, PXL2.

For example, the display driver 200 may supply a scan signal to the pixels PXL1, PXL2 through the scan lines S1, S2, supply a emission control signal to the pixels PXL1, PXL2 through the emission control lines E1, E2, and supply a data signal to the pixels PXL1, PXL2 through the data lines D1, D2.

An entirety or a portion of the display driver 200 may be formed directly onto the substrate 100, or connected to the substrate 100 via a separate constituent element 110 such as a flexible printed circuit board or the like.

For example, the display driver 200 may be installed by various methods such as the Chip on Glass, Chip on Plastic, Tape Carrier Package and Chip on Film, etc.

Meanwhile, although it is illustrated in FIG. 2 that the display driver 200 formed separately from the substrate 100 is installed on the substrate 100, there is no limitation thereto.

For example, an entirety or a portion of the display driver 200 may be formed directly on the substrate, in which case it may be disposed in the first peripheral area NA1 and the second peripheral area NA2 of the substrate 100.

Figure 3:
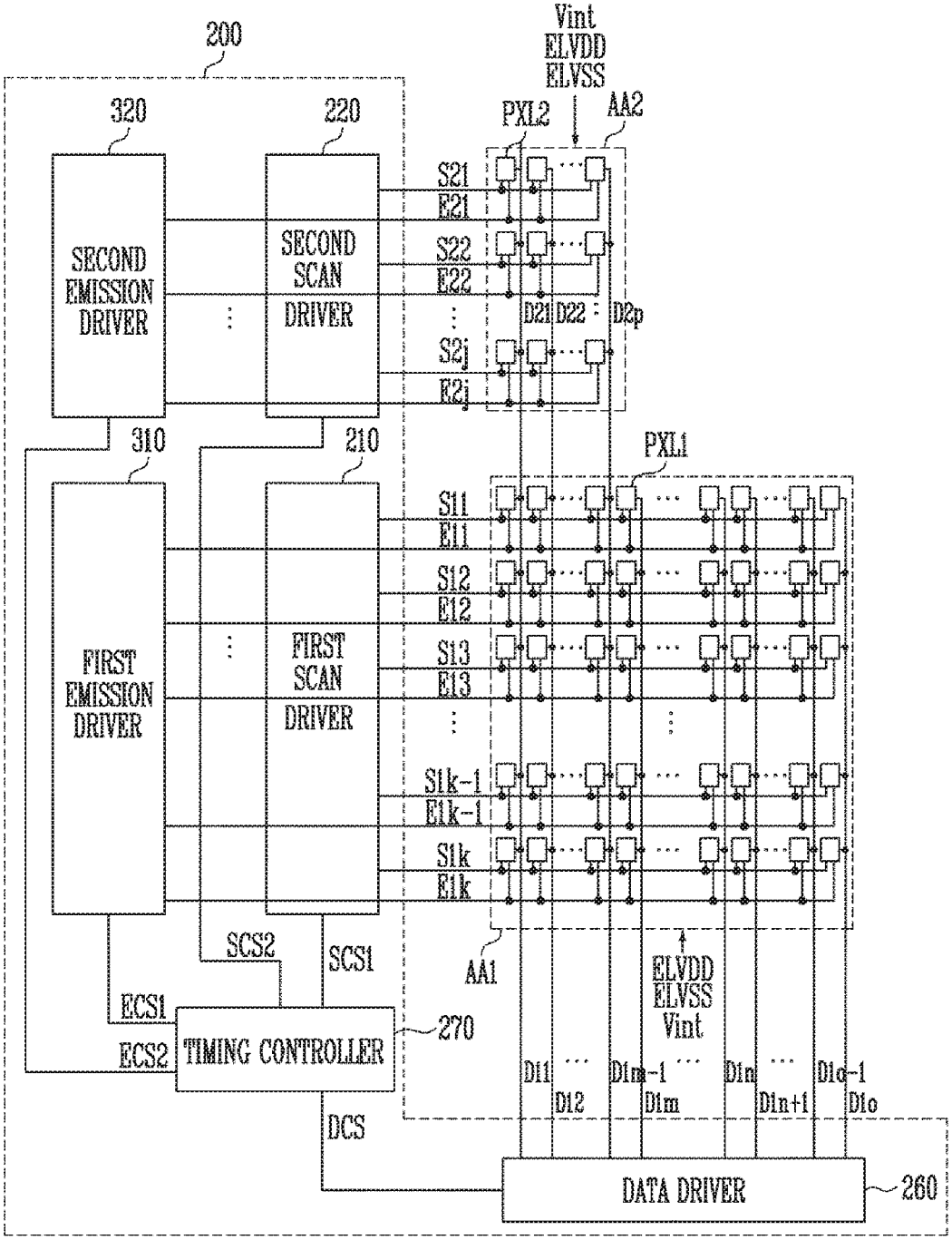
FIG. 3 is a view illustrating in further detail a display driver illustrated in FIG. 2.

FIG. 3 is a view illustrating in further detail the display driver illustrated in FIG. 2.

Referring to FIG. 3, the display driver 200 according to an embodiment of the present disclosure may include a first scan driver 210, a second scan driver 220, a data driver 260, a timing controller 270, a first emission driver 310, and a second emission driver 320.

The first scan driver 210 may supply a first scan signal to the first pixels PXL1 through first scan lines S11~S1*k*.

For example, the first scan driver 210 may sequentially supply the first scan signal to the first scan lines S11~S1*k*.

In the case where the first scan driver 210 is formed directly on the substrate 100, the first scan driver 210 may be disposed in the first peripheral area NA1.

The second scan driver 220 may supply a second scan signal to the second pixels PXL2 through second scan lines S21~S2*j*.

For example, the second scan driver 220 may sequentially supply the second scan signal to the second scan lines S21~S2*j*.

In the case where the second scan driver 220 is formed directly on the substrate 100, the second scan driver 220 may be disposed in the second peripheral area NA2.

The scan signal may be set to a gate on voltage (for example, low voltage) so that a transistor included in the pixels PXL1, PXL2 may be turned on.

The first scan driver 210 and the second driver 220 may operate in response to a first scan control signal SCS1 and a second scan control signal SCS2, respectively.

The data driver 260 may supply a data signal to the first pixels PXL1 through first data lines D11~D1*o*.

The first pixels PXL1 may be connected to a first pixel power source ELVDD and a second pixel power source ELVSS. When necessary, the first pixels PXL1 may be additionally connected to an initialization power source Vint.

Such first pixels PXL1 may be supplied with the data signal through the first data lines D11~D10 when the first scan signal is supplied to the first scan lines S11~S1*k*, and the first pixels PXL1 supplied with the data signal may control the amount of current flowing from the first pixel power source ELVDD to the second pixel power source ELVSS via an organic light emitting diode (not illustrated).

Further, the number of first pixels PXL1 disposed in one row may differ depending on its location.

The data driver 260 may supply data signals to the second pixels PXL2 through second data lines D21~D2*p*.

For example, the second data lines D21~D2*p* may be connected to some of the first data lines D11~D1*m*−1.

Further, the second pixels PXL2 may be connected to the first pixel power source ELVDD and the second pixel power source ELVSS. When necessary, the second pixels PXL2 may be additionally connected to the initialization power source Vint.

Such second pixels PXL2 may be supplied with the data signal from the second data lines D21~D2*p* when the second scan signal is supplied to the second scan lines S21~S2*j*, and the second pixels PXL2 supplied with the data signal may control the amount of current flowing from the first pixel power source ELVDD to the second pixel power source ELVSS via the organic light emitting diode (not illustrated).

Further, the number of second pixels PXL2 disposed in one row may differ depending on its location.

Here, the data driver 260 may operate in response to a data control signal DCS.

The first emission driver 310 may supply a first emission control signal to the first pixels PXL1 through first emission control lines E11~E1*k*.

For example, the first emission driver 310 may sequentially supply the first emission control signal to the first emission control lines E11~E1*k*.

In the case where the first emission driver 310 is formed directly on the substrate 100, the first emission driver 310 may be disposed in the first peripheral area NA1.

In the case when the first pixels PXL1 need not use the first emission control signal, the first emission driver 310 and the first emission control lines E11~E1*k* may be omitted.

The second emission driver 320 may supply a second emission control signal to the second pixels PXL2 through second emission control lines E21~E2*j*.

For example, the second emission driver 320 may sequentially supply the second emission control signal to the second emission control lines E21~E2*j*.

In the case where the second emission driver 320 is formed directly on the substrate 100, the second emission driver 320 may be disposed in the second peripheral area NA2.

In the case when the second pixels PXL2 need not use the second emission control signal, the second emission driver 320 and the second emission control lines E21~E2*j* may be omitted.

The emission control signal is used to control the light emission time of the pixels PXL1, PXL2. For this purpose, the emission control signal may be set to have a wider width than the scan signal.

For example, the emission control signal may be set to a gate off voltage (for example, high voltage) so that the transistor included in the pixels PXL1, PXL2 may be turned off.

The first emission driver 310 and the second emission driver 320 may operate in response to the first emission control signal ECS1 and the second emission control signal ECS2, respectively.

Since the second pixel area AA2 has a smaller surface area than the first pixel area AA1, the number of the second pixels PXL2 may be smaller than the number of the first pixels PXL1, and the lengths of the second scan lines S21~S2*j* and the second emission control lines E21~E2*j* may be shorter than the first scan lines S11~S1*k* and the first emission control lines E11~E1*k*.

The number of second pixels PXL2 connected to any one of the second scan lines S21~S2*j* may be smaller than the number of the first pixels PXL1 connected to any one of the first scan lines S11~S1*k*.

Further, the number of the second pixels PXL2 connected to any one of the second emission control lines E21~E2*j* may be smaller than the number of the first pixels PXL1 connected to any one of the first emission control lines E11~E1*k*.

The timing controller 270 may control the first scan driver 210, the second scan driver 220, the data driver 260, the first emission driver 310, and the second emission driver 320.

For this purpose, the timing controller 270 may supply the first scan control signal SCS1 and the second scan control signal SCS2 to the first scan driver 210 and the second scan driver 220, respectively, and supply the first emission control signal ECS1 and the second emission control signal ECS2 to the first emission driver 310 and the second emission driver 320, respectively.

Here, each of the scan control signals SCS1, SCS2 and the emission control signals ECS1, ECS2 may include at least one clock signal and a start pulse.

The start pulse may control the timing of the first scan signal or the first emission control signal. The clock signal may be used to shift the start pulse.

Further, the timing controller 270 may supply a data control signal DCS to the data driver 260.

In the data control signal DCS, a source start pulse and at least one clock signal may be included. The source start pulse may control a sampling starting time point of the data, and the clock signal may be used to control a sampling operation.

Meanwhile, loads of the first scan lines S11~S1*k* and loads of the second scan lines S21~S2*j* may be different from each other.

That is, since the lengths of the first scan lines S11~S1*k* are longer than the second scan lines S21~S2*j*, and the number of the first pixels PXL1 connected to a same first scan line is greater than the number of the second pixels PXL2 connected to a same scan line, the loads of the first scan lines S11~S1*k* may be greater than the second scan lines S21~S2*j*.

This causes a difference of time constant between the first scan signal and the second scan signal, and eventually, a greater RC delay occurs in the first scan signal than the second scan signal.

Accordingly, the data entry time regarding the first pixels PXL1 becomes shorter than that of the second pixels PXL2, and consequently, a difference of brightness occurs between the first pixels PXL1 and the second pixels PXL2.

Therefore, in the embodiment of the present disclosure, a clock line is separately installed for each of the first scan driver 210 and the second scan driver 220, and the characteristics of the clock signals being supplied to each clock line are adjusted to be different from each other, thereby setting the data entry time of the first pixels PXL1 and the data entry time of the second pixels PXL2 to be similar to each other.

Accordingly, the difference of brightness between the first pixel area AA1 and the second pixel area AA2 may be reduced.

Hereinafter, the configuration of the present disclosure related to the aforementioned will be explained in further detail.

Figure 4:
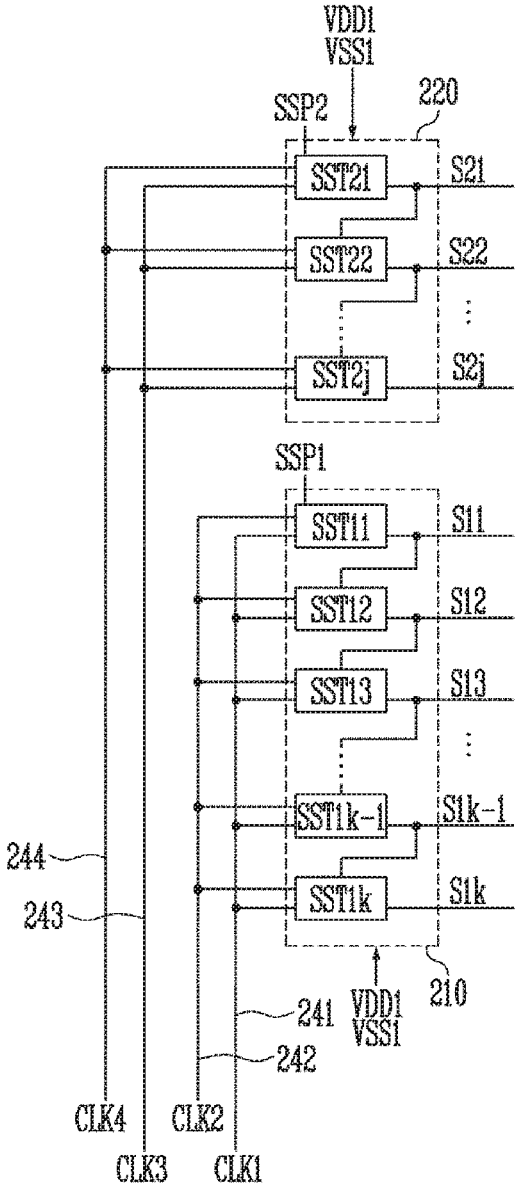
FIG. 4 is a view illustrating in further detail a first scan driver and a second scan driver illustrated in FIG. 3.

FIG. 4 is a view illustrating in further detail the first scan driver and the second scan driver illustrated in FIG. 3.

Referring to FIG. 4, a first clock line 241 and a second clock line 242 may be connected between the timing controller 270 and the first scan driver 210, and a third clock line 243 and a fourth clock line 244 may be connected between the timing controller 270 and the second scan driver 220.

The first and second clock lines 241, 242 associated with the first scan driver 210 and the third and fourth clock lines 243, 244 associated with the second scan driver 220 may be disposed such that they are not electrically connected to each other.

The first clock line 241 and the second clock line 242 may respectively transmit a first clock signal CLK1 and a second clock signal CLK2 being supplied from the timing controller 270 to the first scan driver 210, and the third clock line 243 and the fourth clock line 244 may respectively supply a third clock signal CLK3 and a fourth clock signal CLK4 being supplied from the timing controller 270 to the second scan driver 220.

In the case where the clock lines are not electrically connected as mentioned above, some of the loads of the first scan lines S11~S1*k* become smaller than when the first scan driver 210 and the second scan driver 220 share the same clock line, thereby reducing some of the RC delay of the first scan signal.

The first clock signal CLK1 and the second clock signal CLK2 may have different phases. For example, the second clock signal CLK2 may have a phase difference of 180° compared to the first clock signal CLK1. That is, the second clock signal CLK2 may be an inverted clock signal of the first clock signal CLK1.

The third clock signal CLK3 and the fourth clock signal CLK4 may have different phases. For example, the third clock signal CLK3 may have a phase difference of 180° compared to the fourth clock signal CLK4. That is, the fourth clock signal CLK4 may be an inverted clock signal of the third clock signal CLK3.

The first scan driver 210 may include a plurality of scan stage circuits SST11~SST1*k*.

Each of the scan stage circuits SST11~SST1*k* of the first scan driver 210 may be connected to one end of the first scan lines S11~S1*k*, and may each supply a first scan signal to the first scan lines S11~S1*k*.

Here, the scan stage circuits SST11~SST1*k* may operate in response to the clock signals CLK1, CLK2 being supplied from the timing controller 270. Further, the scan stage circuits SST11~SST1*k* may have the same configuration.

The scan stage circuits SST11~SST1*k* may be supplied with an output signal (that is, scan signal) of a previous scan stage circuit or a start pulse SSP1.

For example, the first scan stage circuit SST11 may be supplied with the start pulse SSP1, and the rest of the scan stage circuits SST12~SST1*k* may be supplied with the output signal of the previous stage circuit.

In another embodiment, the first scan stage circuit SST11 of the first scan driver 210 may use a signal being output from the last scan stage circuit SST2*j* of the second scan driver 220 as the start pulse.

Each of the scan stage circuits SST11~SST1*k* may be supplied with a first driving power source VDD1 and a second driving power source VSS1.

Here, the first driving power source VDD1 may be set to a gate off voltage, for example, a high level voltage. Further, the second driving power source VSS1 may be set to a gate on voltage, for example, a low level voltage.

The second scan driver 220 may include a plurality of scan stage circuits SST21~SST2*j*.

Each of the scan stage circuits SST21~SST2*j* of the second scan driver 220 may be connected to one end of the second scan lines S21~S2*j*, and may supply a second scan signal to the second scan lines S21~S2*j*.

Here, the scan stage circuits SST21~SST2*j* may operate in response to the clock signals CLK3, CLK4 being supplied from the timing controller 270. Further, the scan stage circuits SST21~SST2*j* may have the same configuration.

The scan stage circuits SST21~SST2*j* may be supplied with an output signal (that is, scan signal) of a previous scan stage circuit or a start pulse SSP2.

For example, the first scan stage circuit SST21 may be supplied with the start pulse SSP2, and the rest of the scan stage circuits SST22~SST2*j* may be supplied with the output signal of the previous scan stage circuit.

Further, the last scan stage circuit SST2*j* of the second driver 220 may supply an output signal to the first scan stage circuit SST11 of the first scan driver 210.

Each of the scan stage circuits SST21~SST2*j* may be supplied with the first driving power source VDD1 and the second driver power source VSS1.

In FIG. 4, it is illustrated that the scan drivers 210, 220 each use two clock signals, but the number of the clock signals that the scan drivers 210, 220 use may differ depending on the structure of the scan stage circuit.

Figure 5:
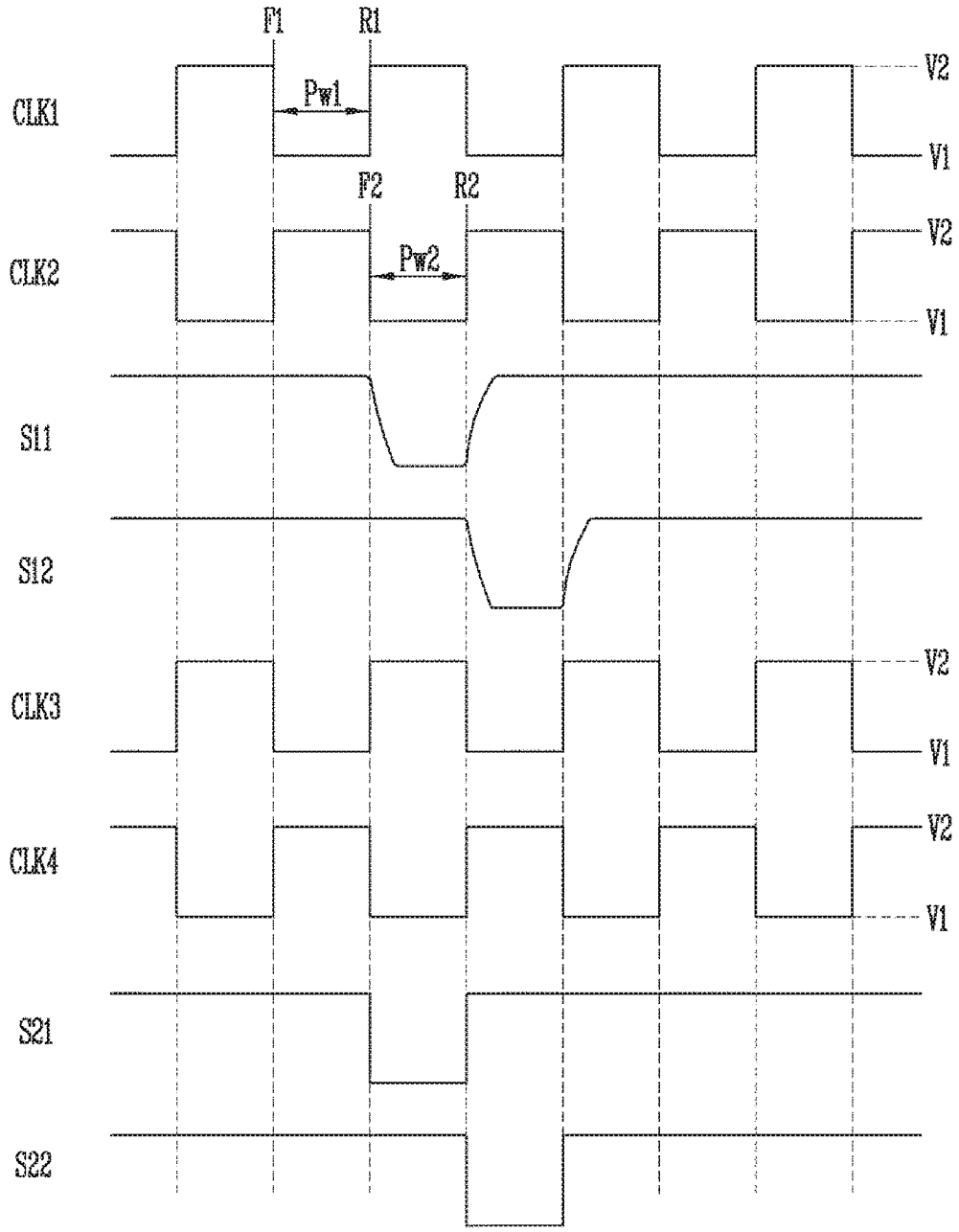
FIG. 5 is a waveform view illustrating a first to fourth clock signals and a first and second scan signals according to the embodiment of the present disclosure.

FIG. 5 is a waveform view of the first to fourth clock signals and the first and second scan signals according to an embodiment of the present disclosure. In FIG. 5, only the first scan signals being supplied to the first first scan line S11 and the second first scan line S12, and the second scan signals being supplied to the first second scan line S21 and the second second scan line S22 are illustrated for convenience of explanation.

Referring to FIG. 5, the timing controller 270 according to the embodiment of the present disclosure may supply clock signals CLK1, CLK2, CLK3, CLK4 having the same signal characteristics.

The clock signals CLK1, CLK2, CLK3 and CLK4 may be clock signals that swing between a first voltage V1 that is a low voltage and a second voltage V2 that is a high voltage.

For example, the first clock signal CLK1 may be set to the same signal as the third clock signal CLK3, and the second clock signal CLK2 may be set to the same signal as the fourth clock signal CLK4.

In the case of supplying the clock signals CLK1, CLK2, CLK3, CLK4 having the same signal characteristics to the first scan driver 210 and the second scan driver 220, due to the high load existing in the first pixel area AA1, a greater signal delay phenomenon may occur in the first scan signal than in the second scan signal.

That is, it is possible to improve the brightness difference between the first pixel area AA1 and the second pixel area AA2 by separating the clock lines, but if there is a big difference of load between the first pixel area AA1 and the second pixel area AA2, additional compensation to the difference of brightness may be necessary.

In such a case, the timing controller 270 according to the embodiment of the present disclosure may further reduce the brightness difference by altering the clock signals CLK1, CLK2, CLK3, CLK4.

Here, the timing controller 270 may alter at least one of a pulse width, a length of a rising edge period, and a length of a falling edge period.

Figure 6:
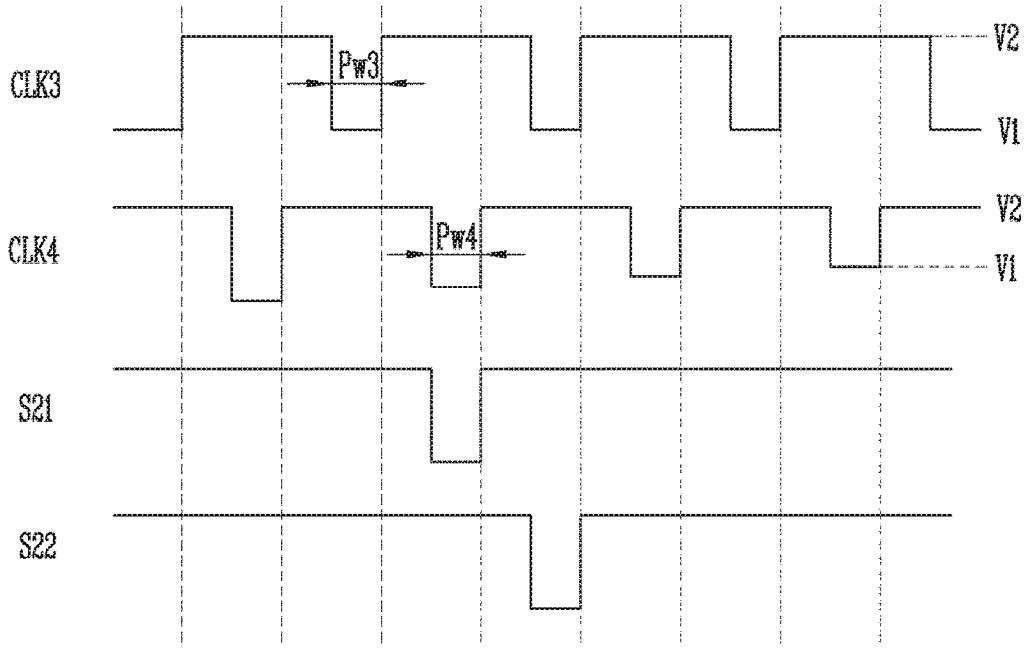
FIG. 6 is a waveform view illustrating the third and fourth clock signals and the second scan signal according to the embodiment of the present disclosure.

FIG. 6 is a waveform view of the third and fourth clock signals and the second scan signal according to the embodiment of the present disclosure. In FIG. 6, only the second scan signals being supplied to the first second scan line S21 and the second second scan line S22 are illustrated for convenience of explanation.

Referring to FIGS. 5 and 6, a pulse width Pw3 of the third clock signal CLK3 may be set to be different from a pulse width Pw1 of the first clock signal CLK1.

For example, the pulse width Pw3 of the third clock signal CLK3 may be set to be smaller than the pulse width Pw1 of the first clock signal CLK1.

Further, a pulse width Pw4 of the fourth clock signal CLK4 may be set to be different from the pulse width Pw2 of the second clock signal CLK2.

For example, the pulse width Pw4 of the fourth clock signal CLK4 may be set to be smaller than the pulse width Pw2 of the second clock signal CLK2.

The pulse width Pw1 of the first clock signal CLK1 and the pulse width Pw2 of the second clock signal CLK2 may be the same, and the pulse width Pw3 of the third clock signal CLK3 and the pulse width Pw4 of the fourth clock signal CLK4 may be the same.

By reducing the pulse widths Pw3, Pw4 of the clock signals CLK3, CLK4 being supplied to the second scan driver 220, the supplying period (or pulse width) of the second scan signal may be reduced as illustrated in FIG. 6.

Therefore, the data entry time of the second pixels PXL2 may be adjusted to be similar to the data entry time of the first pixels PXL1, and accordingly, the difference of brightness between the first pixel area AA1 and the second pixel area AA2 may be reduced.

Figure 7:
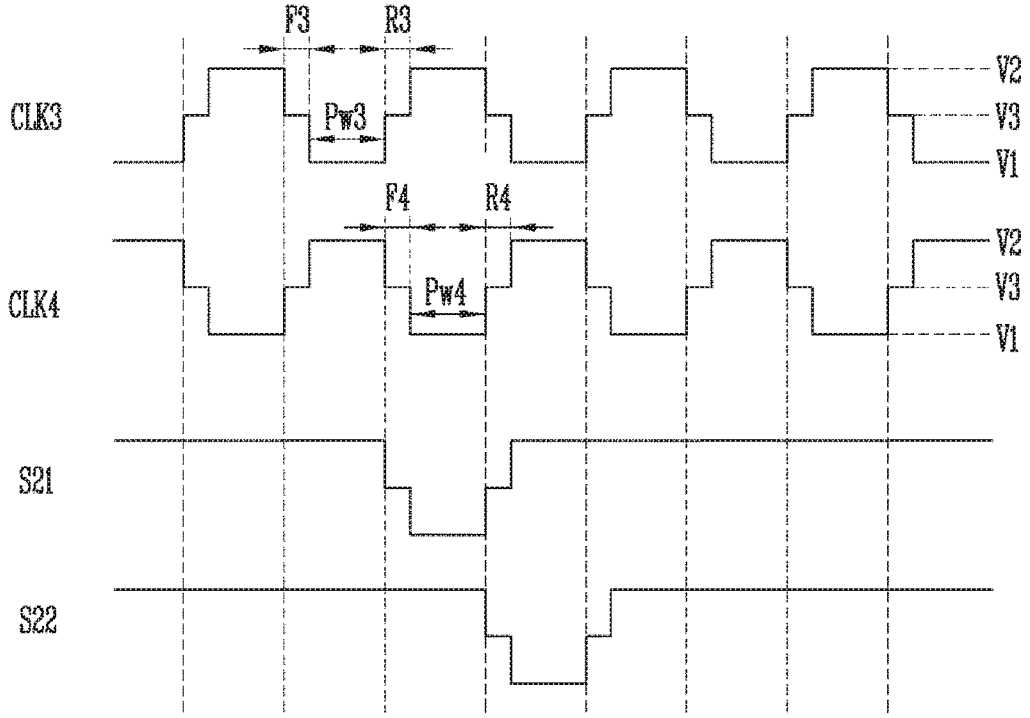
FIG. 7 is a waveform view illustrating the third and fourth clock signals and the second scan signal according to another embodiment of the present disclosure.

FIG. 7 is a waveform view of the third and fourth clock signals and the second scan signal according to another embodiment of the present disclosure. In FIG. 7, only the second scan signals being supplied to the first second scan line S21 and the second second scan line S22 are illustrated for convenience of explanation.

Referring to FIGS. 5 and 7, a falling edge period F3 of the third clock signal CLK3 may be set to be different from a falling edge period F1 of the first clock signal CLK1.

For example, the falling edge period F3 of the third clock signal CLK3 may be set to be longer than the falling edge period F1 of the first clock signal CLK1.

Further, a rising edge period R3 of the third clock signal CLK3 may be set to be different from a rising edge period R1 of the first clock signal CLK1.

For example, the rising edge period R3 of the third clock signal CLK3 may be set to be longer than the rising edge period R1 of the first clock signal CLK1.

The first clock signal CLK1 illustrated in FIG. 5 is an ideal clock signal, and its falling edge period F1 and the rising edge period R1 may be set to "0". However, an actual first clock signal CLK1 may have a falling edge period F1 and a rising edge period R1 having a predetermined length due to an RC component of the actual first clock line 241.

Meanwhile, a falling edge period F4 of the fourth clock signal CLK4 may be set to be different from a falling edge period F2 of the second clock signal CLK2.

For example, the falling edge period F4 of the fourth clock signal CLK4 may be set to be longer than the falling edge period F2 of the second clock signal CLK2.

Further, a rising edge period R4 of the fourth clock signal CLK4 may be set to be different from a rising edge period R2 of the second clock signal CLK2.

For example, the rising edge period R4 of the fourth clock signal CLK4 may be set to be longer than the rising edge period R2 of the second clock signal CLK2.

The second clock signal CLK2 illustrated in FIG. 5 is an ideal clock signal, and its falling edge period R2 and the rising edge period R2 may be set to "0". However, the actual second clock signal CLK2 may have a falling edge period F2 and a rising edge period R2 having a predetermined length by the RC component of the second clock line 242.

The falling edge period F1 and the rising edge period R1 of the first clock signal CLK1 may have the same length as the falling edge period F2 and the rising edge period R2 of the second clock signal CLK2, respectively.

The falling edge period F3 and the rising edge period R3 of the third clock signal CLK3 may have the same length as the falling edge period F4 and the rising edge period R4 of the fourth clock signal CLK4, respectively.

The third clock signal CLK3 and the fourth clock signal CLK4 may change from a second voltage V2 (high voltage) to a first voltage V1 (low voltage) via a third voltage V3 (intermediate voltage) during the falling edge periods F3, F4, respectively.

Further, the third clock signal CLK3 and the fourth clock signal CLK4 may change from the first voltage V1 (low voltage) to the second voltage V2 (high voltage) via the third voltage V3 (intermediate voltage) during the rising edge periods R3, R4, respectively.

Accordingly, the third clock signal CLK3 and the fourth clock signal CLK4 may have a staircase wave form of swinging between the first voltage V1 and the second voltage V2 via the third voltage V3.

For example, the first voltage V1 may be set to a negative voltage, the second voltage V2 may be set to a positive voltage, and the third voltage V3 may be set to a ground voltage.

FIG. 7 illustrates an embodiment where all the falling edge periods F3, F4 and the rising edge periods R3, R4 of the third and fourth clock signals CLK3, CLK4 are adjusted, but only one of the falling edge periods F3, F4 and the rising edge periods R3, R4 may be adjusted instead.

By extending the falling edge periods F3, F4 and/or the rising edge periods R3, R4 of the clock signals CLK3, CLK4 being supplied to the second scan driver 220, the supplying period (or pulse width) of the second scan signal may be reduced as illustrated in FIG. 7, and the second scan signal may change in a similar form as the first scan signal as illustrated in FIG. 5.

Therefore, the data entry time of the second pixels PXL2 may be adjusted to be similar to the data entry time of the first pixels PXL1, and accordingly, the brightness difference between the first pixel area AA1 and the second pixel area AA2 may be reduced.

Figure 8:
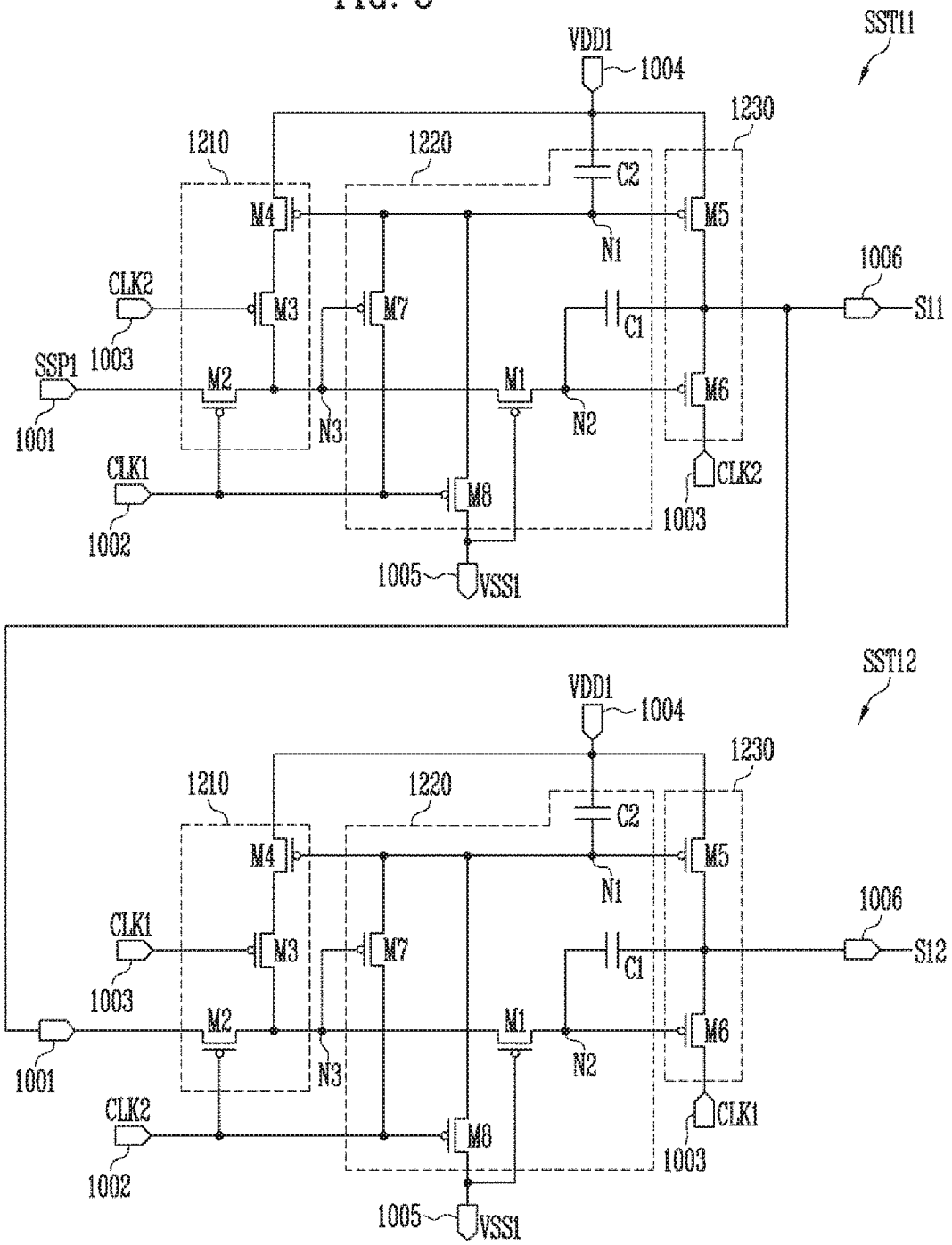
FIG. 8 is a view illustrating an embodiment of a scan stage circuit illustrated in FIG. 4.

FIG. 8 is a view illustrating an embodiment of the scan stage circuit illustrated in FIG. 4.

FIG. 8 illustrates the scan stage circuits SST11, SST12 of the first scan driver 210 for convenience of explanation.

Referring to FIG. 8, the first scan stage circuit SST11 may include a first driving circuit 1210, a second driving circuit 1220, and an output circuit 1230.

The output circuit 1230 may control a voltage being supplied to an output terminal 1006 in response to a voltage of a first node N1 and a second node N2. For this purpose, the output circuit 1230 may include a fifth transistor M5 and a sixth transistor M6.

The fifth transistor M5 may be connected between a fourth input terminal 1004 to which the first driving power source VDD1 is input and an output terminal 1006, and a gate electrode may be connected to the first node N1. Such a fifth transistor M5 may control the connection of the fourth input terminal 1004 and the output terminal 1006 in response to the voltage being applied to the first node N1.

The sixth transistor M6 may be connected between the output terminal 1006 and a third input terminal 1003, and a gate electrode may be connected to the second node N2. Such a sixth transistor M6 may control the connection of the output terminal 1006 and the third input terminal 1003 in response to the voltage being applied to the second node N2.

Such an output circuit 1230 may be driven by a buffer. In addition, the fifth transistor M5 and/or the sixth transistor M6 may include a plurality of transistors connected in parallel to one another.

The first driving circuit 1210 may control a voltage of a third node N3 in response to signals being supplied to the first input terminal 1001 to the third input terminal 1003.

For this purpose, the first driving circuit 1210 may include a second transistor M2 to a fourth transistor M4.

The second transistor M2 may be connected between the first input terminal 1001 and the third node N3, and a gate electrode may be connected to the second input terminal 1002. Such a second transistor M2 may control the connection of the first input terminal 1001 and the third node N3 in response to the signal being supplied to the second input terminal 1002.

The third transistor M3 and the fourth transistor M4 may be connected in series between the third node N3 and the fourth input terminal 1004. In fact, the third transistor M3 may be connected between the fourth transistor M4 and the third node N3, and a gate electrode may be connected to the third input terminal 1003. Such a third transistor M3 may control the connection of the fourth transistor M4 and the third node N3 in response to the signal being supplied to the third input terminal 1003.

The fourth transistor M4 may be connected between the third transistor M3 and the fourth input terminal 1004, and a gate electrode may be connected to the first node N1. Such a fourth transistor M4 may control the connection of the third transistor M3 and the fourth input terminal 1004 in response to the voltage of the first node N1.

The second driving circuit 1220 may control the voltage of the first node N1 in response to the second input terminal 1002 and the voltage of the third node N3. For this purpose, the second driving circuit 1220 may include a first transistor M1, a seventh transistor M7, an eighth transistor M8, a first capacitor C1 and a second capacitor C2.

The first capacitor C1 may be connected between the second node N2 and the output terminal 1006. Such a first capacitor C1 charges a voltage corresponding to a turn-on and turn-off of the sixth transistor M6.

The second capacitor C2 may be connected between the first node N1 and the fourth input terminal 1004. Such a second capacitor C2 may charge a voltage being applied to the first node N1.

The seventh transistor M7 may be connected between the first node N1 and the second input terminal 1002, and a gate electrode may be connected to the third node N3. Such a seventh transistor M7 may control the connection of the first node N1 and the second input terminal 1002 in response to the voltage of the third node N3.

The eighth transistor M8 may be disposed between the first node N1 and the fifth input terminal 1005 to which the second driving power source VSS1 is supplied, and a gate electrode may be connected to the second input terminal 1002. Such an eighth transistor M8 may control the connection of the first node N1 and the fifth input terminal 1005 in response to the signal of the second input terminal 1002.

The first transistor M1 may be connected between the third node N3 and the second node N2, and a gate electrode may be connected to the fifth input terminal 1005. Such a first transistor M1 may maintain an electrical connection of the third node N3 and the second node N2 while maintaining a turn-on state. In addition, the first transistor M1 may limit a voltage falling width of the third node N3 in response to the voltage of the second node N2. In other words, Even if the voltage of the second node N2 falls below the second driving power source VSS1, the voltage of the third node N3 does not fall below a voltage value obtained by subtracting a threshold voltage of the first transistor M1 from the second driving power source VSS1. This will be explained in further detail hereinafter.

The second scan stage circuit SST12 and the rest of the scan stage circuits SST13~SST1*k* may have the same configuration as the first scan stage circuit SST11.

Further, the second input terminal 1002 of a $j^{th}$ (j being an odd number or an even number) scan stage circuit SST1*j* may be supplied with the first clock signal CLK1, and the third input terminal of the $j^{th}$ scan stage circuit SST1*j* may be supplied with the second clock signal CLK2. The second input terminal 1002 of a $j+1^{th}$ scan stage circuit SST1*j*+1 may be supplied with the second clock signal CLK2, and the third input terminal 1003 of the $j+1^{th}$ scan stage circuit SST1*j*+1 may be supplied with the first clock signal CLK1.

FIG. 8 illustrates the stage circuits included in the first scan driver 210, but the stage circuits included in the second scan driver 220 may have the same configuration.

However, the second scan driver 220 may use the third clock signal CLK3 and the fourth clock signal CLK4 instead of the first clock signal CLK1 and the second clock signal CLK2.

Figure 9:
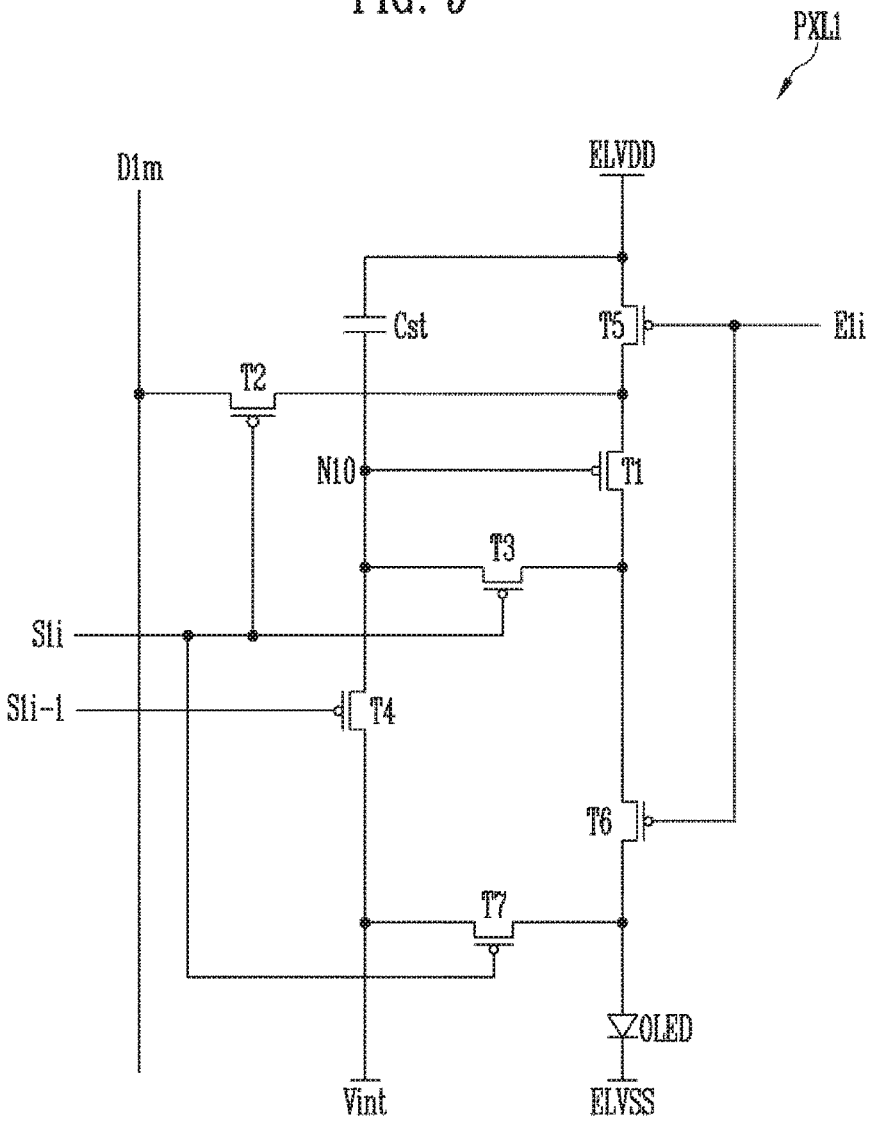
FIG. 9 is a view illustrating an embodiment of a first pixel illustrated in FIG. 2.

FIG. 9 is a view illustrating an embodiment of the first pixel illustrated in FIG. 2.

FIG. 9 illustrates the first pixel PXL1 connected to an $m^{th}$ first data line D1*m* and an $i^{th}$ first scan line S1*i* for convenience of explanation.

Referring to FIG. 9, the first pixel PXL1 according to the embodiment of the present disclosure may include an organic light emitting diode OLED, a first transistor T1 to a seventh transistor T7 and a storage capacitor Cst.

An anode of the organic light emitting diode OLED may be connected to the first transistor T1 via the sixth transistor T6, and a cathode of the organic light emitting diode OLED may be connected to the second pixel power source ELVSS. Such an organic light emitting diode OLED may generate light of a certain brightness in response to the amount of current being supplied from the first transistor T1.

The first pixel power source ELVDD may be set to a higher voltage than the second pixel power source ELVSS so that a current may flow to the organic light emitting diode OLED.

For example, the first pixel power source ELVDD may be set to a positive voltage, and the second pixel power source ELVSS may be set to a negative voltage.

The seventh transistor T7 may be connected between the initialization power source and the anode of the organic light emitting diode OLED. Further, the gate electrode of the seventh transistor T7 may be connected to the $i^{th}$ first scan line S1*i*. Such a seventh transistor T7 may be turned-on when a scan signal is supplied to the $i^{th}$ first scan line S1*i*, and supply the voltage of the initialization power source Vint to the anode of the organic light emitting diode OLED. Here, the initialization power source Vint may be set to a lower voltage than the data signal.

The sixth transistor T6 may be connected between the first transistor T1 and the anode of the organic light emitting diode OLED. Further, the gate electrode of the sixth transistor T6 may be connected to the $i^{th}$ first emission control line E1*i*. Such a sixth transistor T6 may be turned-off when the emission control signal is supplied to the $i^{th}$ first emission control line E1*i*, but turned-on in other cases.

The fifth transistor T5 may be connected between the first pixel power source ELVDD and the first transistor T1. Further, the gate electrode of the fifth transistor T5 may be connected to the $i^{th}$ first emission control line E1*i*. Such a fifth transistor T5 may be turned-off when a emission control signal is supplied to the $i^{th}$ first emission control line E1*i*, but turned-on in other cases.

A first electrode of the first transistor T1 (driving transistor) may be connected to the first pixel power source ELVDD via the fifth transistor T5, and a second electrode of the first transistor T1 may be connected to the anode of the organic light emitting diode OLED via the sixth transistor T6. Further, the gate electrode of the first transistor T1 may be connected to a tenth node N10. Such a first transistor T1 may control the amount of current flowing from the first pixel power source ELVDD to the second pixel power source ELVSS via the organic light emitting diode OLED in response to the voltage of the tenth node N10.

The third transistor T3 may be connected between the second electrode of the first transistor T1 and the tenth node N10. Further, the gate electrode of the third transistor T3 may be connected to the $i^{th}$ first scan line S1*i*. Such a third transistor T3 may be turned-on when a scan signal is supplied to the $i^{th}$ first scan line S1*i*, and electrically connect the second electrode of the first transistor T1 and the tenth node N10. Therefore, when the third transistor T3 is turned-on, the first transistor T1 may be connected in a diode form.

The fourth transistor T4 may be connected between the tenth node N10 and the initialization power source Vint. Further, the gate electrode of the fourth transistor T4 may be connected to the $i-1^{th}$ first scan line S1*i*−1. Such a fourth transistor T4 may be turned-on when a scan signal is supplied to the $i-1^{th}$ first scan line S1*i*−1, and supply the voltage of the initialization power source Vint to the tenth node N10.

The second transistor T2 may be connected between the $m^{th}$ first data line D1*m* and the first electrode of the first transistor T1. Further, the gate electrode of the second transistor T2 may be connected to the $i^{th}$ first scan line S1*i*. Such a second transistor T2 may be turned-on when a scan signal is supplied to the $i^{th}$ first scan line S1*i*, and electrically connect the $m^{th}$ first data line D1*m* and the first electrode of the first transistor T1.

The storage capacitor Cst may be connected between the first pixel power source ELVDD and the tenth node N10. Such a storage capacitor Cst may store a voltage corresponding to the data signal and the threshold voltage of the first transistor T1.

Meanwhile, the second pixel PXL2 may have the same circuit as the first pixel PXL1. Therefore, detailed explanation on the second pixel PXL2 will be omitted.

Further, since the pixel structure explained in FIG. 9 is just an example of using a scan line and an emission control line, the pixels PXL1, PXL2 of the present disclosure are not limited to the aforementioned pixel structure. In fact, the pixel may have a circuit structure capable of supplying current to the organic light emitting diode OLED, and the structure may be selected from structures well known in the art.

In the present disclosure, the organic light emitting diode OLED may generate lights of various colors such as red, green and blue light in response to the amount of current being supplied from the driving transistor, but there is no limitation thereto. For example, the organic light emitting diode OLED may generate white light in response to the amount of current being supplied from the driving transistor. In this case, a color image may be realized using a separate color filter or the like.

Additionally, although the transistors in the present disclosure are P-type transistors for convenience of explanation, there is no limitation thereto. In other words, the transistors may be formed as N-type transistors.

Further, the gate off voltage and the gate on voltage of the transistors may be set to voltages of other levels depending on the type of the transistors.

For example, in the case of a P-type transistor, the gate off voltage and the gate on voltage may be set to a high level voltage and a low level voltage, respectively, and in the case of an N-type transistor, the gate off voltage and the gate on voltage may be set to a low level voltage and a high level voltage, respectively.

Figure 10:
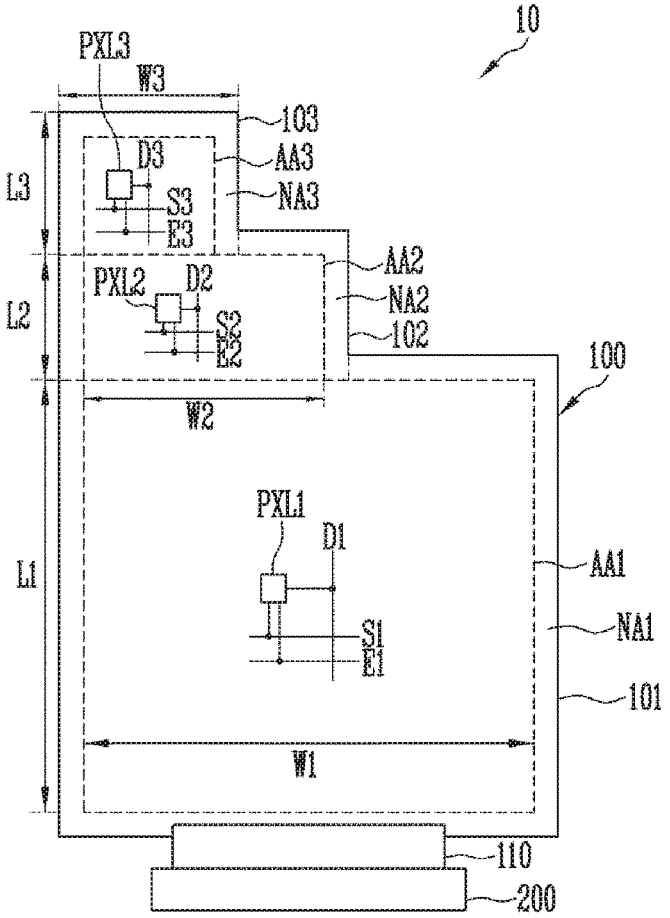
FIG. 10 is a view illustrating the display device according to the embodiment of the present disclosure.

FIG. 10 is a view illustrating a display device according to an embodiment of the present disclosure.

Referring to FIG. 10, explanation will be made with a main focus on components that are different from the aforementioned embodiment (for example, FIG. 2), and explanation on components overlapping the aforementioned embodiment will be omitted. Accordingly, hereinafter, explanation will be made based on the third pixel area AA3 and the third pixels PXL3.

Referring to FIG. 10, the display device 10 according to an embodiment of the present disclosure may include pixel areas AA1, AA2, AA3, peripheral areas NA1, NA2, NA3, and pixels PXL1, PXL2, PXL3.

The third pixel area AA3 may be disposed at one side of the second pixel area AA2. Accordingly, the second pixel area AA2 may be disposed between the first pixel area AA1 and the third pixel area AA3, and the first pixel area AA1 and the third pixel area AA3 may be disposed such that they are spaced apart from each other.

Further, the third pixel area AA3 may have a smaller surface area than the first pixel area AA1.

For example, a width W3 of the third pixel area AA3 may be set to be smaller than a width W1 of the first pixel area AA1, and a length L3 of the third pixel area AA3 may be set to be shorter than a length L1 of the first pixel area AA1.

Further, the third pixel area AA3 may have a smaller surface area than the second pixel area AA2.

For example, the width W3 of the third pixel area AA3 may be set to be smaller than the width W2 of the second pixel area AA2, and the length L3 of the third pixel area AA3 may be set to be shorter than the length L2 of the second pixel area AA2.

However, there is no limitation thereto, and thus according to the embodiment, the surface area of the third pixel area AA3 may be set to be greater than the second pixel area AA2.

The third peripheral area NA3 may exist on a periphery of the third pixel area AA3, and may surround at least a portion of the third pixel area AA3.

The width of the third peripheral area NA3 may be set to be same overall. However, there is no limitation thereto, and thus the width of the third peripheral area NA3 may be set differently depending on its location.

The third pixels PXL3 may be disposed in the third pixel area AA3, and each of the third pixels PXL3 may be connected to a third scan line S3, a third emission control line E3, and a third data line D3. When necessary, each of the third pixels PXL3 may be connected to a plurality of scan lines.

Further, the third pixels PXL3 may emit light of a certain brightness according to a control by the display driver 200, and for this purpose, the third pixels PXL3 may include a light emitting element, for example, organic light emitting diode.

The display driver 200 may control the light emission of the pixels PXL1, PXL2, PXL3 by supplying driving signals to the pixels PXL1, PXL2, PXL3.

For example, the display driver 200 may supply a scan signal to the pixels PXL1, PXL2, PXL3 through the scan lines S1, S2, S3, supply a emission control signal to the pixels PXL1, PXL2, PXL3 through the emission control lines E1, E2, E3, and supply a data signal to the pixels PXL1, PXL2, PXL3 through the data lines D1, D2, D3.

The substrate 100 may be formed in various shapes such that the pixel areas AA1, AA2, AA3 and the peripheral areas NA1, NA2, NA3 may be set thereon.

For example, the substrate 100 may include a plate shape base substrate 101, a first subsidiary substrate 102 extending from one end of the base substrate to one side, and a second subsidiary substrate 103 extending from one end of the first subsidiary substrate 102 to one side.

Here, the second subsidiary substrate 103 may have a smaller surface area than the first subsidiary substrate 102. For example, the width of the second subsidiary substrate 103 may be set to be smaller than the width of the first subsidiary substrate 102, and the length of the second subsidiary substrate 103 may be set to be shorter than the length of the first subsidiary substrate 102.

The third pixel area AA3 may have various shapes. For example, the third pixel area AA3 may have a polygonal shape, circular shape or the like. Further, at least a portion of the third pixel area AA3 may have a curve shape.

In accordance with a change of shape of the third pixel area AA3, the number of the third pixels PXL3 disposed in one row may differ depending on its location.

Further, the third pixels PXL3 may have the pixel structure of FIG. 9 mentioned above, but there is no limitation thereto.

Figure 11:
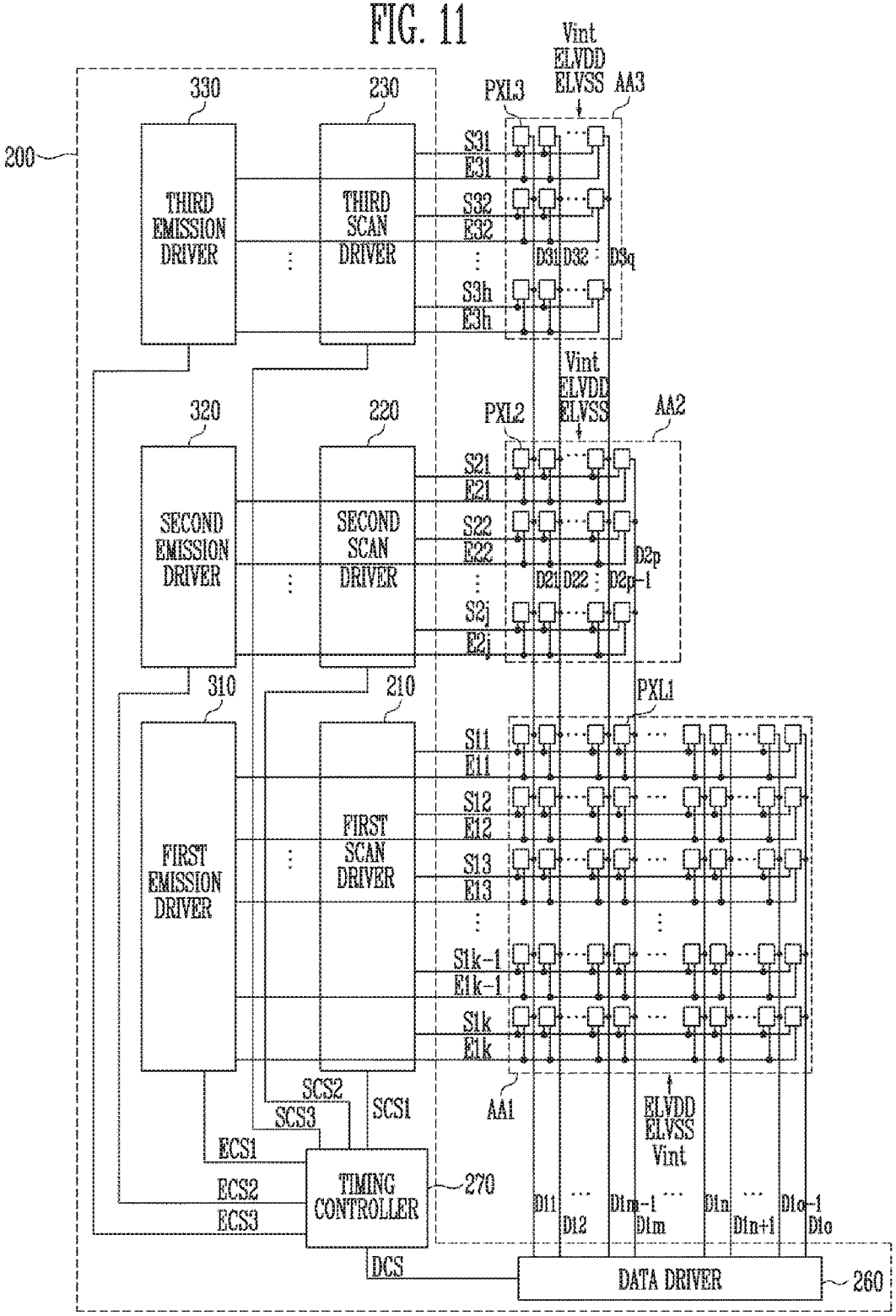
FIG. 11 is a view illustrating in further detail the display driver illustrated in FIG. 10.

FIG. 11 is a view illustrating in further detail the display driver illustrated in FIG. 10.

Referring to FIG. 11, explanation will be made with a main focus on components that are different from the aforementioned embodiment (for example, FIG. 3), and explanation on components overlapping the aforementioned embodiment will be omitted. Accordingly, hereinafter, explanation will be made based on the third scan driver 230 and the third emission driver 330.

Referring to FIG. 11, the display driver 200 according to the embodiment of the present disclosure may include a first scan driver 210, a second scan driver 220, a third scan driver 230, a data driver 260, a timing controller 270, a first emission driver 310, a second emission driver 320, and a third emission driver 330.

The third scan driver 230 may supply a third scan signal to the third pixels PXL3 through third scan lines S31~S3*h*.

For example, the third scan driver 230 may supply the third scan signal to the third scan lines S31~S3*h* sequentially.

In the case where the third scan driver 230 is formed directly on the substrate 100, the third scan driver 230 may be disposed in the third peripheral area NA3.

The third scan driver 230 may operate in response to a third scan control signal SCS3.

The data driver 260 may supply a data signal to the third pixels PXL3 through third data lines D31~D3*q*.

Further, the third pixels PXL3 may be connected to the first pixel power source ELVDD and the second pixel power source ELVSS. When necessary, the third pixels PXL3 may be additionally connected to the initialization power source Vint.

Such third pixels PXL3 may be supplied with the data signal from the third data lines D31~D3*q* when a third scan signal is supplied to the third scan lines S31~S3*h*, and the third pixels PXL3 supplied with the data signal may control the amount of current flowing from the first pixel power source ELVDD to the second pixel power source ELVSS via the organic light emitting diode (not illustrated).

Further, the number of the third pixels PXL3 disposed in one row may differ depending on its location.

For example, the third data lines D31~D3*q* may be connected to some of the second data lines D21~D2*p*−1.

Further, the second data lines D21~D2*p* may be connected to some of the first data lines D11~D1*m*.

The third emission driver 330 may supply a third emission control signal to the third pixels PXL3 through third emission control lines E31~E3*h*.

For example, the third emission driver 330 may supply the third emission control signal to the third emission control lines E31~E3*h* sequentially.

In the case where the third emission driver 330 is formed directly on the substrate 100, the third emission driver 330 may be disposed in the third peripheral area NA3.

The third emission driver 330 may operate in response to the third emission control signal ECS3.

In the case where the third pixels PXL3 need not use the third emission control signal, the third emission driver 330 and the third emission control lines E31~E3*h* may be omitted.

Since the third pixel area AA3 has a smaller surface area than the first pixel area AA1, the number of the third pixels PXL3 may be smaller than the number of the first pixels PXL1, and the lengths of the third scan lines S31~S3*h* and the third emission control lines E31~E3*h* may be shorter than the first scan lines S11~S1*k* and the first emission control lines E11~E1*k*.

The number of the third pixels PXL3 connected to any one of the third scan lines S31~S3*h* may be smaller than the number of the first pixels PXL1 connected to any one of the first scan lines S11~S1*k*.

Further, the number of the third pixels PXL3 connected to any one of the third emission control lines E31~E3*h* may be smaller than the number of the first pixels PXL1 connected to any one of the first emission control lines E11~E1*k*.

As illustrated in FIG. 10, in the case where the surface area of the third pixel area AA3 is set to be smaller than the second pixel area AA2, the number of the third pixels PXL3 may be smaller than the number of the second pixels PXL2, and the lengths of the third scan lines S31~S3*h* and the third emission control lines E31~E3*h* may be shorter than the second scan lines S21~S2*j* and the second emission control lines E21~E2*j*.

The number of the third pixels PXL3 connected to any one of the third scan lines S31~S3*h* may be smaller than the number of the second pixels PXL2 connected to any one of the second scan lines S21~S2*j*.

Further, the number of the third pixels PXL3 connected to any one of the third emission control lines E31~E3*h* may be smaller than the number of the second pixels PXL2 connected to any one of the second emission control lines E21~E2*j*.

The timing controller 270 may supply the third scan control signal SCS3 and the third emission control signal ECS3 to the third scan driver 230 and the third emission driver 330, respectively, in order to control the third scan driver 230 and the third emission driver 330.

The third scan control signal SCS3 and the third emission control signal ECS3 may each include at least one clock signal and a start pulse.

Figure 12:
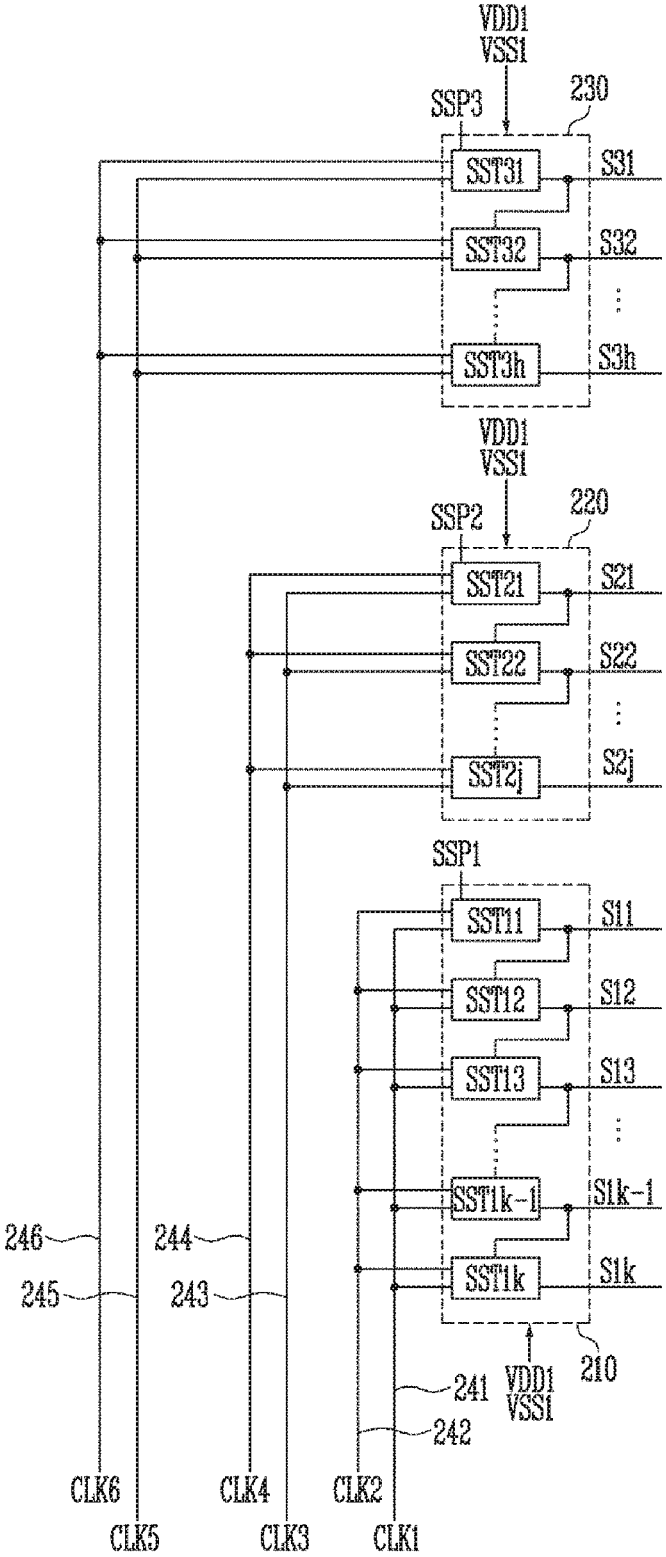
FIG. 12 is a view illustrating in further detail the first to third scan drivers illustrated in FIG. 11.

FIG. 12 is a view illustrating in further detail the first to third scan drivers illustrated in FIG. 11. Referring to FIG. 12, explanation will be made with a main focus on components that are different from the aforementioned embodiment (for example, FIG. 4), and explanation on components overlapping the aforementioned embodiment will be omitted. Accordingly, hereinafter, explanation will be made based on the third scan driver 230.

In order to improve the difference of brightness between the pixel areas AA1, AA2, AA3, a fifth clock line 245 and a sixth clock line 246 associated with the third scan driver 230 may be disposed such that they are electrically separated from other clock lines 241, 242, 243, 244.

The fifth clock line 245 and the sixth clock line 246 may be connected between the timing controller 270 and the third scan driver 230, and may respectively transmit a fifth clock signal CLK5 and a sixth clock signal CLK6 supplied from the timing controller 270 to the third scan driver 230.

The fifth clock signal CLK5 and the sixth clock signal CLK6 may have different phases. For example, the sixth clock signal CLK6 may have a phase difference of 180° compared to the fifth clock signal CLK5. That is, the sixth clock signal CLK6 may be an inverted clock signal of the fifth clock signal CLK5.

The third scan driver 230 may include a plurality of scan stage circuits SST31~SST3*h*.

Each of the scan stage circuits SST31~SST3*h* of the third scan driver 230 may be connected to one end of the third scan lines S31~S3*h*, and may supply a third scan signal to the third scan lines S31~S3*h*.

Here, the scan stage circuits SST31~SST3*h* may operate in response to the clock signals CLK5, CLK6 being supplied from the timing controller 270. Further, the scan stage circuits SST31~SST3*h* may have the same configuration.

The scan stage circuits SST31~SST3*h* may be supplied with an output signal (that is, scan signal) or a start pulse SSP3 of a previous scan stage circuit.

For example, the first scan stage circuit SST31 may be supplied with the start pulse SSP3, and the rest of the scan stage circuits SST32~SST3*h* may be supplied with an output signal of the previous stage circuit.

Further, the last scan stage circuit SST3*h* of the third scan driver 230 may supply an output signal to the first scan stage circuit SST21 of the second scan driver 220.

Each of the scan stage circuits SST31~SST3*h* may be supplied with a first driving power source VDD1 and a second driving power source VSS1.

FIG. 12 illustrates that the scan drivers 210, 220, 230 each use two clock signals, but the number of clock signals that the scan drivers 210, 220, 230 use may differ depending on the structure of the scan stage circuit.

Figure 13:
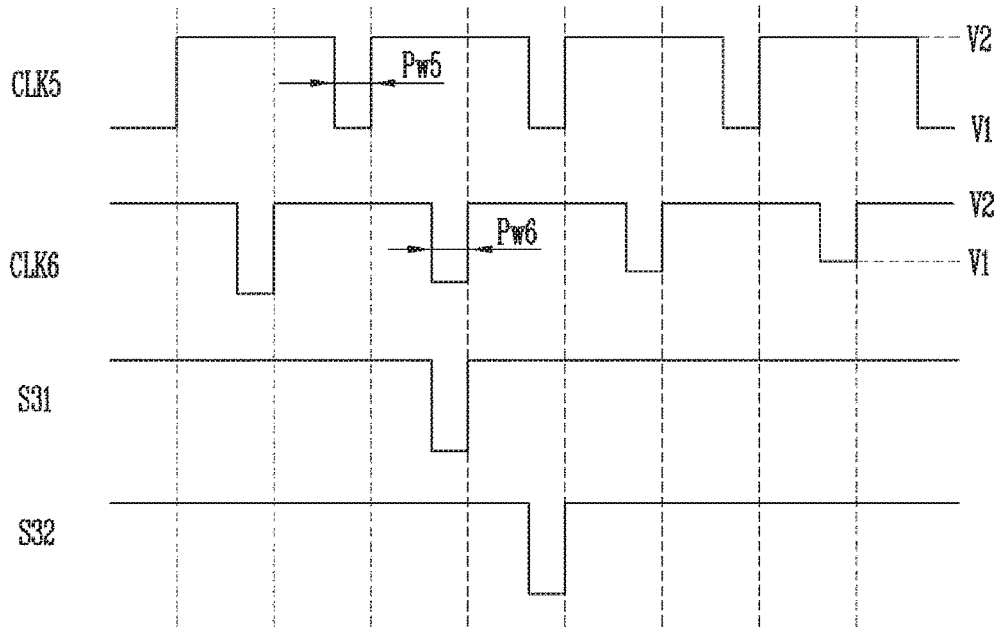
FIG. 13 is a waveform view illustrating a fifth and sixth clock signals and a third scan signal according to the embodiment of the present disclosure.

FIG. 13 is a waveform view of the fifth and sixth clock signals and the third scan signal according to an embodiment of the present disclosure. FIG. 13 illustrates only the third scan signals that are supplied to the first third scan line S31 and the second third scan line S32, for convenience of explanation.

Referring to FIG. 5 and FIG. 13, the characteristics of the fifth and sixth clock signals CLK5, CLK6 may be set to be different from the first and second clock signals CLK1, CLK2.

For example, a pulse width Pw5 of the fifth clock signal CLK5 may be set to be smaller than the pulse width Pw1 of the first clock signal CLK1.

Further, a pulse width Pw6 of the sixth clock signal CLK6 may be set to different from the pulse width Pw2 of the second clock signal CLK2.

For example, the pulse width Pw6 of the sixth clock signal CLK6 may be set to be smaller than the pulse width Pw2 of the second clock signal CLK2.

The pulse width Pw5 of the fifth clock signal CLK5 and the pulse width Pw6 of the sixth clock signal CLK6 may be the same.

By reducing the pulse widths Pw5, Pw6 of the clock signals CLK5, CLK6 being supplied to the third scan driver 230, the supplying period (or pulse width) of the third scan signal S31 and S32 may be reduced as illustrated in FIG. 13.

Therefore, the data entry time of the third pixels PXL3 may be adjusted to be similar to the data entry time of the first pixels PXL1, and accordingly, the difference of brightness between the first pixel area AA1 and the third pixel area AA3 may be reduced.

Meanwhile, in the case where the surface area of the third pixel area AA3 is set to be different from the second pixel area AA2, loads of the third scan lines S31~S3*h* and loads of the second scan lines S21~S2*j* may be different from each other.

Therefore, in order to improve the difference of brightness between the second pixel area AA2 and the third pixel area AA3, the characteristics of the fifth and sixth clock signals CLK5, CLK6 may be set to be different from the third and fourth clock signals CLK3, CLK4.

For example, in the case where the surface area of the third pixel area AA3 is set to be smaller than the second pixel area AA2, the pulse width Pw5 of the fifth clock signal CLK5 may be set to be smaller than the pulse width Pw3 of the third clock signal CLK3, and the pulse width Pw6 of the sixth clock signal CLK6 may be set to be smaller than the pulse width Pw4 of the fourth clock signal CLK4.

Figure 14:
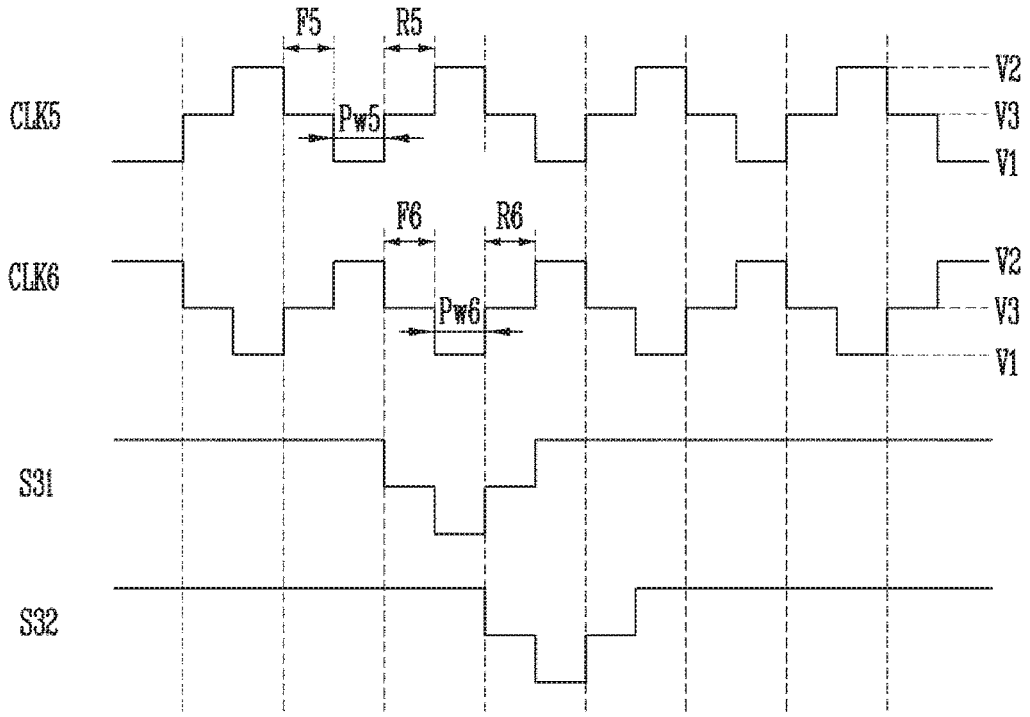
FIG. 14 is a waveform view illustrating the fifth and sixth clock signals and the third scan signal according to another embodiment of the present disclosure.

FIG. 14 is a waveform view illustrating the fifth and sixth clock signals and the third scan signal according to another embodiment of the present disclosure. FIG. 14 illustrates only the third scan signals being supplied to the first third scan line S31 and the second third scan line S32, for convenience of experience.

Referring to FIG. 5 and FIG. 14, a falling edge period F5 of the fifth clock signal CLK5 may be set to be different from the falling edge period F1 of the first clock signal CLK1.

For example, the falling edge period F5 of the fifth clock signal CLK5 may be set to be longer than the falling edge period F1 of the first clock signal CLK1.

Further, a rising edge period R5 of the fifth clock signal CLK5 may be set to be different from the rising edge period R1 of the first clock signal CLK1.

For example, the rising edge period R5 of the fifth clock signal CLK5 may be set to be longer than the rising edge period R1 of the first clock signal CLK1.

Meanwhile, a falling edge period F6 of the sixth clock signal CLK6 may be set to be different from the falling edge period F2 of the second clock signal CLK2.

For example, the falling edge period F6 of the sixth clock signal CLK6 may be set to be longer than the falling edge period F2 of the second clock signal CLK2.

Further, a rising edge period R6 of the sixth clock signal CLK6 may be set to be different from the rising edge period R2 of the second clock signal CLK2.

For example, the rising edge period R6 of the sixth clock signal CLK6 may be set to be longer than the rising edge period R2 of the second clock signal CLK2.

The falling edge period R5 and rising edge period R5 of the of the fifth clock signal CLK5 may have the same length as the falling edge period R6 and the rising edge period R6 of the sixth clock signal CLK6, respectively.

The fifth clock signal CLK5 and the sixth clock signal CLK6 may change from the second voltage V2 (high voltage) to the first voltage V1 (low voltage) via the third voltage V3 (intermediate voltage) during the falling edge periods F5, F6, respectively.

Further, the fifth clock signal CLK5 and the sixth clock signal CLK6 may change from the first voltage V1 (low voltage) to the second voltage V2 (high voltage) via the third voltage V3 (intermediate voltage) during the rising edge periods R5, R6, respectively.

Accordingly, the fifth clock signal CLK5 and the sixth clock signal CLK6 may have the staircase wave form which swings between the first voltage V1 and the second voltage V2 via the third voltage V3.

By extending the falling edge periods F5, F6 and/or the rising edge periods R5, R6 of the clock signals CLK5, CLK6 being supplied to the third scan driver 230, the supplying period (or pulse width) of the third scan signal may also be reduced as illustrated in FIG. 14, and the third scan signal may change in a similar form as the first scan signal illustrated in FIG. 5.

Therefore, the data entry time of the third pixels PXL3 may be adjusted to be similar to the data entry time of the first pixels PXL1, and accordingly, the difference of brightness between the first pixel area AA1 and the third pixel area AA3 may be reduced.

Meanwhile, in the case where the surface area of the third pixel area AA3 is set to be different from the second pixel area AA2, the loads of the third scan lines S31~S3*h* and the loads of the second scan lines S21~S2*j* may be different from each other.

For example, in the case where the surface area of the third pixel area AA3 is set to be smaller than the second pixel area AA2, the falling edge period F5 and the rising edge period R5 of the fifth clock signal CLK5 may be formed to be longer than the falling edge period F3 and the rising edge period R3 of the third clock signal CLK3, respectively.

For this purpose, the duration time of the third voltage V3 may be extended during the falling edge period F5 and the rising edge period R5 of the fifth clock signal CLK5.

Further, the falling edge period F6 and the rising edge period R6 of the sixth clock signal CLK6 may be formed to be longer than the falling edge period F4 and the rising edge period R4 of the fourth clock signal CLK4, respectively.

For this purpose, the duration time of the third voltage V3 may be extended during the falling edge period F6 and the rising edge period R6 of the sixth clock signal CLK6.

Figure 15:
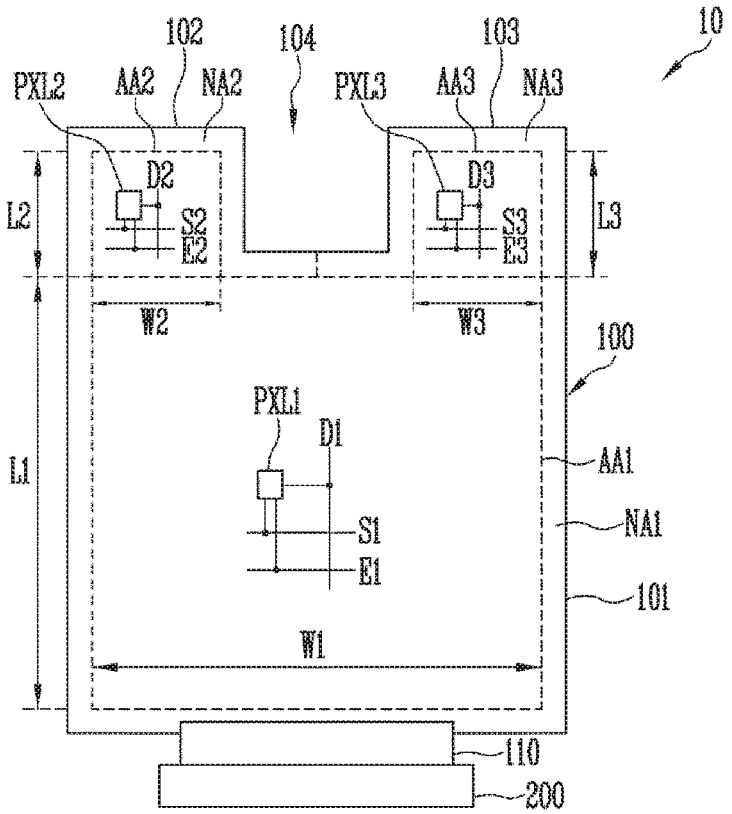
FIG. 15 is a view illustrating the display device according to the embodiment of the present disclosure.

FIG. 15 is a view illustrating a display device according to an embodiment of the present disclosure.

Referring to FIG. 15, explanation will be made with a main focus on components that are different from the aforementioned embodiment (for example, FIG. 2 and FIG. 10), and explanation on components overlapping the aforementioned embodiment will be omitted. Accordingly, hereinafter, explanation will be made based on the third pixel area AA3 and the third pixels PXL3.

Referring to FIG. 10, the display device 10 according to an embodiment of the present disclosure may include the pixel areas AA1, AA2, AA3, the peripheral areas NA1, NA2, NA3, and the pixels PXL1, PXL2, PXL3.

The second pixel area AA2 and the third pixel area AA3 may be disposed at one side of the first pixel area AA1. Here, the second pixel area AA2 and the third pixel area AA3 may be disposed such that they are spaced apart from each other.

The first pixel area AA1 may have a greater surface area than the second pixel area AA2 and the third pixel area AA3.

For example, the width W1 of the first pixel area AA1 may be set to be greater than the widths W2, W3 of the other pixel areas AA2, AA3, and the length L1 of the first pixel area AA1 may be set to be greater than the lengths L2, L3 of the other pixel areas AA2, AA3.

Further, the second pixel area AA2 and the third pixel area AA3 may each have a smaller surface area than, the same surface area as, or a different surface area from the first pixel area AA1.

For example, the width W2 of the second pixel area AA2 may be set to be the same as or different from the width W3 of the third pixel area AA3, and the length L2 of the second pixel area AA2 may be set to be the same as or different from the length L3 of the third pixel area AA3.

The substrate 100 may be formed in various shapes such that the aforementioned pixel areas AA1, AA2, AA3 and the peripheral areas NA1, NA2, NA3 may be set thereon.

For example, the substrate 100 may include the plate shape base substrate 101, the first subsidiary substrate 102 and the second subsidiary substrate 103 extending from one end of the base substrate 101 to one side.

The first subsidiary substrate 102 and the second subsidiary substrate 103 may be formed integrally with the base substrate 101, and a concave part 104 may exist between the first subsidiary substrate 102 and the second subsidiary substrate 103.

The concave part 104 may be an area of the substrate 100 of which a portion has been removed, whereby the first subsidiary substrate 102 and the second subsidiary substrate 103 may be spaced apart from each other.

The first subsidiary substrate 102 and the second subsidiary substrate 103 may each have a smaller surface area than, the same surface area as, or a different surface area from the base substrate 101.

The first subsidiary substrate 102 and the second subsidiary substrate 103 may be formed in various shapes such that the pixel areas AA2, AA3 and the peripheral areas NA2, NA3 may be set thereon.

In this case, the aforementioned first pixel area AA1 and the first peripheral area NA1 may be defined on the base substrate 101, the second pixel area AA2 and the second peripheral area NA2 may be defined on the first subsidiary substrate 102, and the third pixel area AA3 and the third peripheral area NA3 may be defined on the second subsidiary substrate 103.

The first pixel area AA1 may have various shapes. For example, the first pixel area AA1 may have a polygonal shape, circular shape or the like. Further, at least a portion of the first pixel area AA1 may have a curve shape.

The second pixel area AA2 and the third pixel area AA3 may each have various shapes. For example, the second pixel area AA2 and the third pixel area AA3 may have a polygonal shape, circular shape or the like. Further, at least a portion of the second pixel area and the third pixel area AA3 may have a curve shape.

For example, corner parts of each of the second pixel area AA2 and the third pixel area AA3 may have an angular shape, an inclined shape and a curve shape and the like.

Figure 16:
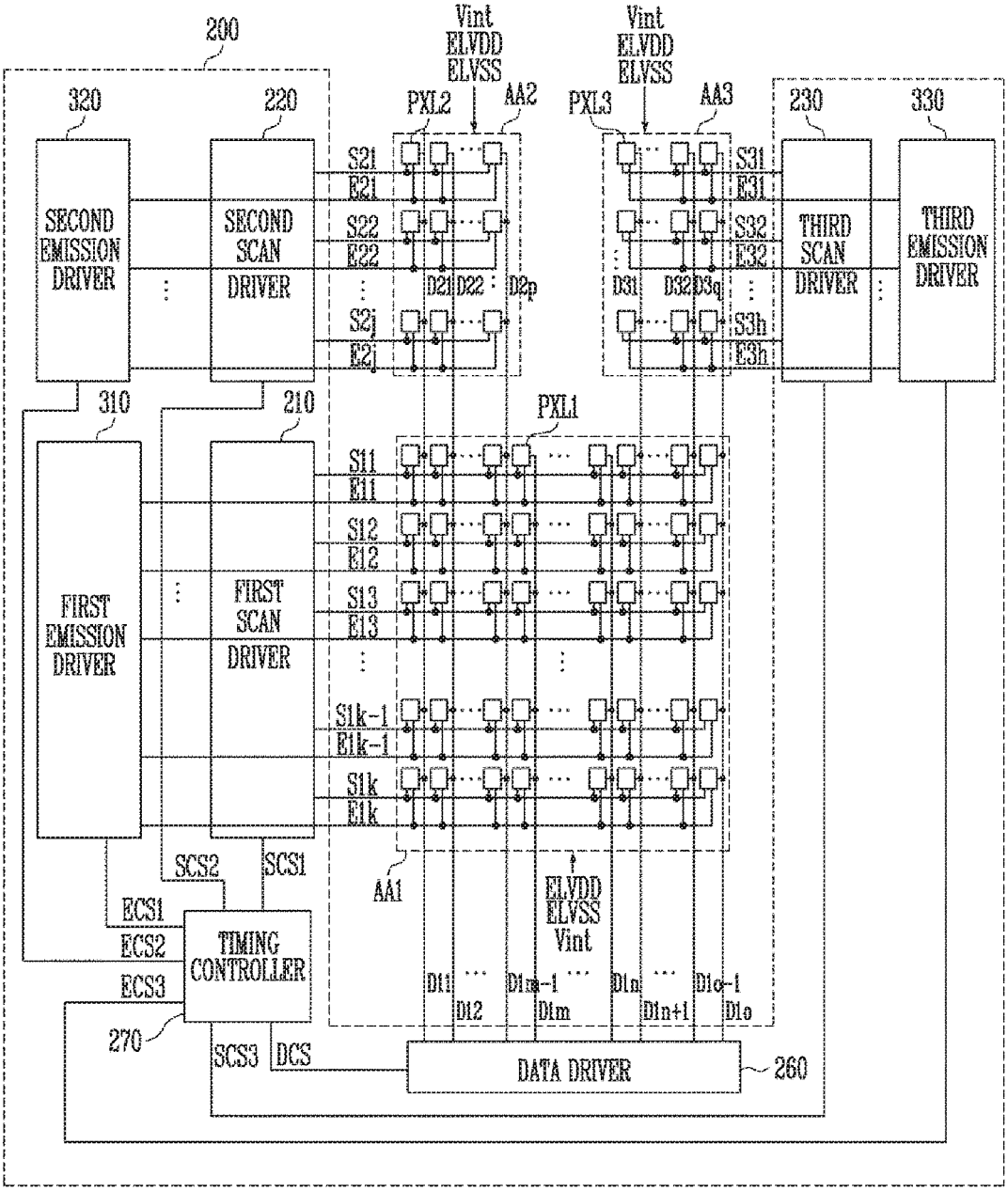
FIG. 16 is a view illustrating in further detail the display driver illustrated in FIG. 15.

FIG. 16 is a detailed view of the display driver illustrated in FIG. 15.

Referring to FIG. 16, explanation will be made with a main focus on components that are different from the aforementioned embodiment (for example, FIG. 3 and FIG. 11), and explanation on components overlapping the aforementioned embodiment will be omitted. Accordingly, hereinafter, explanation will be made based on the third scan driver 230 and the third emission driver 330.

Referring to FIG. 16, the display driver 200 according to the embodiment of the present disclosure may include the first scan driver 210, the second scan driver 220, the third scan driver 230, the data driver 260, the timing controller 270, the first emission driver 310, the second emission driver 320, and the third emission driver 330.

The third scan driver 230 may supply the third scan signal to the third pixels PXL3 through the third scan lines S31~S3*h*.

For example, the third scan driver 230 may supply the third scan signal to the third scan lines S31~S3*h*, sequentially.

In the case where the third scan driver 230 is formed directly on the substrate 100, the third scan driver 230 may be disposed in the third peripheral area NA3.

The third scan driver 230 may operate in response to the third scan control signal SCS3.

The data driver 260 may supply the data signal to the third pixels PXL3 through the third data lines D31~D3*q*.

Further, the third pixels PXL3 may be connected to the first pixel power source ELVDD and the second pixel power source ELVSS. When necessary, the third pixels PXL3 may be additionally connected to the initialization power source Vint.

Such third pixels PXL3 may be supplied with the data signal from the third data lines D31~D3*q* when the third scan signal is being supplied to the third scan lines S31~S3*h*, and the third pixels PXL3 supplied with the data signal may control the amount of current flowing from the first pixel power source ELVDD to the second pixel power source ELVSS via the organic light emitting diode (not illustrated).

Further, the number of the third pixels PXL3 disposed in one row may differ depending on their location.

For example, the third data lines D31~D3*q* may be connected to some of the first data lines D1*n*+1~D1*o*.

Further, the second data lines D21~D2*p* may be connected to some of the other first data lines D11~D1*m*−1.

The third emission driver 330 may supply the third emission control signal to the third pixels PXL3 through the third emission control lines E31~E3*h*.

For example, the third emission driver 330 may supply the third emission control signal to the third emission control lines E31~E3*h* sequentially.

In the case where the third emission driver 330 is formed directly on the substrate 100, the third emission driver 330 may be disposed in the third peripheral area NA3.

In the case of a structure where the third pixels PXL3 need not use the third emission control signal, the third emission driver 330 and the third emission control lines E31~E3*h* may be omitted.

The third emission driver 330 may operate in response to the third emission control signal ECS3.

Since the third pixel area AA3 has a smaller surface area than the first pixel area AA1, the number of the third pixels PXL3 may be smaller than the number of the first pixels PXL1, and the lengths of the third scan lines S31~S3*h* and the third emission control lines E31~E3*h* may be shorter than the first scan lines S11~S1*k* and the first emission control lines E11~E1*k*.

The number of the third pixels PXL3 connected to any one of the third scan lines S31~S3*h* may be smaller than the number of the first pixels PXL1 connected to any one of the first scan line S11~S1*k*.

Further, the number of the third pixels PXL3 connected to any one of the third emission control lines E31~E3*h* may be smaller than the number of the first pixels PXL1 connected to any one of the first emission control lines E11~E1*k*.

The timing controller 270 may supply the third scan control signal SCS3 and the third emission control signal ECS3 to the third scan driver 230 and the third emission driver 330, respectively, in order to control the third scan driver 230 and the third emission driver 330.

The third scan control signal SCS3 and the third emission control signal ECS3 may each include at least one clock signal and a start pulse.

Figure 17:
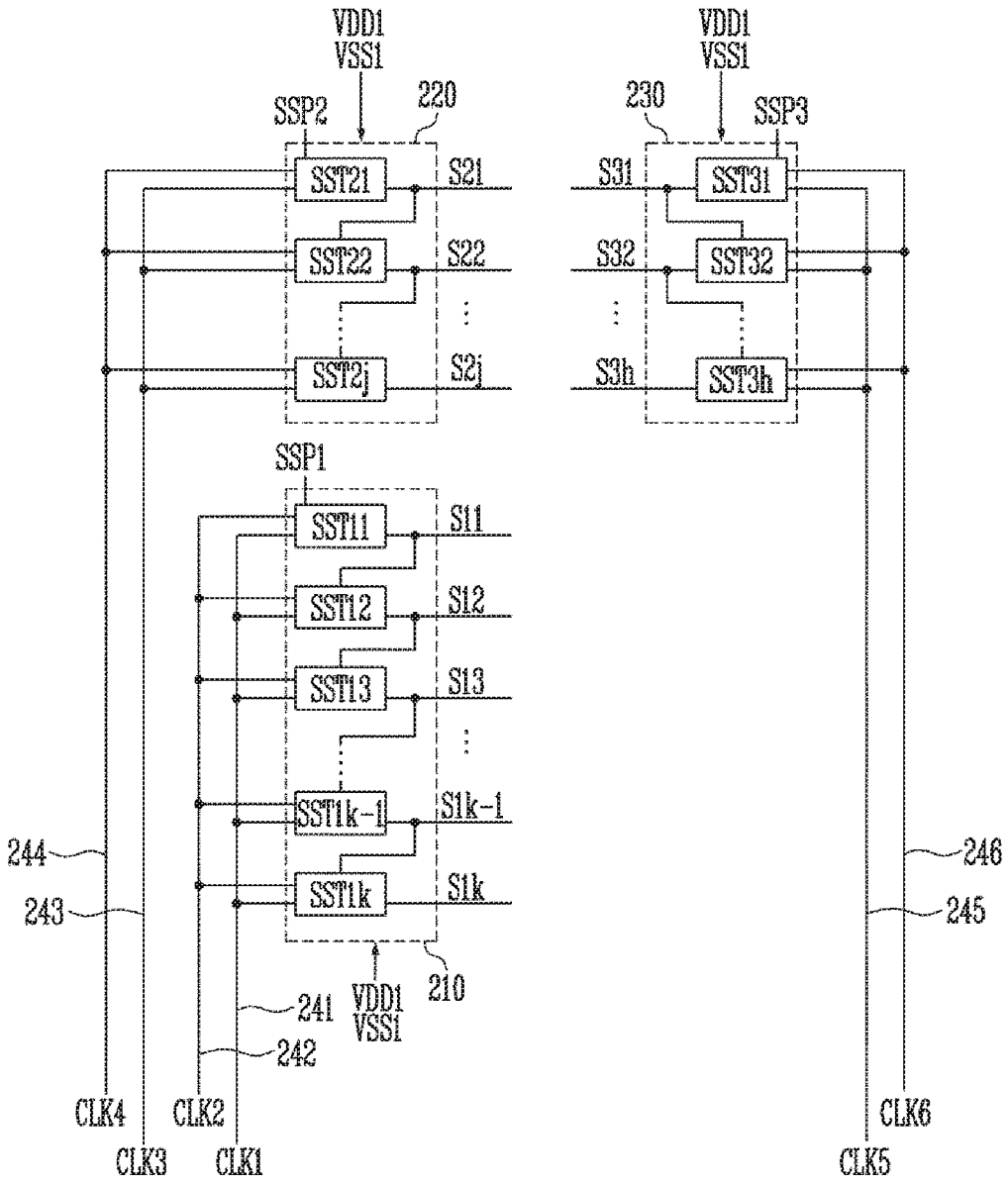
FIG. 17 is a view illustrating in further detail the first to third drivers illustrated in FIG. 16.

FIG. 17 is a view illustrating in further detail the first to third scan drivers illustrated in FIG. 16. Referring to FIG. 17, explanation will be made with a main focus on components that are different from the aforementioned embodiment (for example, FIG. 4 and FIG. 12), and explanation on components overlapping the aforementioned embodiment will be omitted. Accordingly, hereinafter, explanation will be made based on the third scan driver 230.

In order to improve the difference of brightness between the pixel areas AA1, AA2, AA3, the fifth clock line 245 and the sixth clock line 246 may be electrically separated from other clock lines 241, 242, 243, 244.

The fifth clock line 245 and the sixth clock line 246 may be connected between the timing controller 270 and the third scan driver 230 to respectively transmit the fifth clock signal CLK5 and the sixth clock signal CLK6 being supplied from the timing controller 270 to the third scan driver 230.

The fifth clock signal CLK5 and the sixth clock signal CLK6 may have different phases. For example, the sixth clock signal may have a phase difference of 180° compared to the fifth clock signal CLK5. That is, the sixth clock signal CLK6 may be an inverted clock signal of the fifth clock signal CLK5.

The third scan driver 230 may include a plurality of scan stage circuits SST31~SST3*h*.

Each of the scan stage circuits SST31~SST3*h* of the third scan driver 230 may be connected to one end of the third scan lines S31~S3*h*, and may supply the third scan signal to the third scan lines S31~S3*h*.

Here, the scan stage circuits SST31~SST3*h* may operate in response to the clock signals CLK5, CLK6 being supplied from the timing controller 270. Further, the scan stage circuits SST31~SST3*h* may have the same configuration.

The scan stage circuits SST31~SST3*h* may be supplied with an output signal (that is, scan signal) or a start pulse SSP3 of a previous scan stage circuit.

For example, the first scan stage circuit SST31 may be supplied with the start pulse SSP3, and the rest of the scan stage circuits SST32~SST3*h* may be supplied with the output signal of the previous stage circuit.

Further, the last scan stage circuit SST3*h* of the third scan driver 230 may supply the output signal to the first scan stage circuit SST21 of the second scan driver 220.

Each of the scan stage circuits SST31~SST3*h* may be supplied with the first driving power source VDD1 and the second driving power source VSS1.

In FIG. 17, it is illustrated that the scan drivers 210, 220, 230 each use two clock signals, but the number of the clock signals that the scan drivers 210, 220, 230 use may differ depending on the structure of the scan stage circuit.

In order to improve the difference of brightness between the first pixel area AA1 and the third pixel area AA3, the characteristics of the fifth and sixth clock signals CLK5, CLK6 may be set to be different from the first and second clock signals CLK1, CLK2.

For example, at least one of the pulse width of the fifth and sixth clock signals CLK5, CLK6, the length of the rising edge period and the length of the falling edge period may be set to be different from the first and second clock signals CLK1, CLK2.

Further, in the case where the surface areas of the second pixel area AA2 and the third pixel area AA3 are set to be different from each other, in order to improve the difference of brightness between the second pixel area AA2 and the third pixel area AA3, the characteristics of the fifth and sixth clock signals CLK5, CLK6 may be set to be different from the third and fourth clock signals CLK3, CLK4.

The configuration of adjusting the pulse width of the fifth and sixth clock signals CLK5, CLK6, the length of the rising edge period and the falling edge period was already explained hereinabove, and thus detailed explanation thereof is omitted.

According to the embodiment of the present disclosure, clock signals provide to different scan lines have a different signal characteristic, for example, different pulse widths, different lengths of a rising edge period or different length of a falling edge period. The pulse widths of the clock signals may be inversely proportional to the number of pixels connected to one signal line. The lengths of rising edge periods and falling edge periods may be inversely proportional to the number of pixels connected to one signal line. As such, the display device may have an image of uniform brightness regardless the number of pixels connected to one signal line.

In the drawings and specification, there have been disclosed typical embodiments of the invention, and although specific terms are employed, they are used in a generic and descriptive sense only and not for purposes of limitation. It will be understood by those of ordinary skill in the art that various changes in form and details may be made therein without departing from the spirit and scope of the present invention as defined by the following claims.

What is claimed is:

1. A display device comprising:

a pixel area including a first pixel area, a second pixel area disposed adjacent to one edge of the first pixel area and a third pixel area disposed adjacent to the one edge of the first pixel area to be spaced apart from the second pixel area;

first pixels disposed in the first pixel area and connected to first scan lines;

second pixels disposed in the second pixel area and connected to second scan lines;

third pixels disposed in the third pixel area and connected to third scan lines;

a timing controller configured to supply a first clock signal, a second clock signal, and a third clock signal to a first clock line, a second clock line, and a third clock line, respectively;

a first scan driver disposed on a first side of the pixel area, connected to the timing controller through the first clock line disposed on the first side of the pixel area, connected to all of the first scan lines and configured to generate first scan signals using the first clock signal and to supply the first scan signals to all of the first scan lines;

a second scan driver disposed on the first side of the pixel area, connected to the timing controller through the second clock line disposed on the first side of the pixel area, connected to all of the second scan lines and not connected to the first scan lines, and configured to generate second scan signals using the second clock signal and to supply the second scan signals to all of the second scan lines;

a third scan driver disposed on a second side of the pixel area opposing the first side of the pixel area, connected to the timing controller through the third clock line disposed on the second side of the pixel area, connected to all of the third scan lines, and configured to generate third scan signals using the third clock signal and to supply the third scan signals to all of the third scan lines;

a first emission driver disposed on the first side of the pixel area, connected to all of first emission lines disposed in the first pixel area and configured to supply first emission signals to all of the first emission lines;

a second emission driver disposed on the first side of the pixel area, connected to all of second emission lines disposed in the second pixel area and not connected to the first emission lines, and configured to supply second emission signals to all of the second emission lines;

a third emission driver disposed on the second side of the pixel area opposing the first side of the pixel area, connected to all of third emission lines disposed in the third pixel area and not connected to the second emission lines, and configured to supply third emission signals to all of the third emission lines, wherein the first pixel area has width greater than that of the second pixel area and the third pixel area, wherein the first scan driver is disposed between the first emission driver and the first pixel area, the second scan driver is disposed between the second emission driver and the second pixel area, and the third scan driver is disposed between the third emission driver and the third pixel area, wherein each of the first scan driver and second scan drivers includes scan stages, wherein each of the scan stages includes a first driving circuit, a second driving circuit, an output circuit, first to third nodes, first to fifth input terminals, and an output terminal, wherein the first driving circuit controls a voltage of the third node in response to signals supplied to the first input terminal, the second input terminal and the third input terminal, wherein the second driving circuit controls a voltage of the first node in response to a voltage of the second input terminal and the voltage of the third node and controls a voltage of the second node in response to the voltage of the third node and a voltage supplied to the fifth input terminal, wherein the output circuit controls a voltage supplied to an output terminal in response to the voltage of the first node and the voltage of the second node, wherein, for a first scan stage of the first scan driver, the first input terminal is supplied with a scan signal from a final scan stage circuit of the second scan driver, the second input terminal is supplied with a fourth clock signal having a different phase compared to the first clock signal, the third input terminal is supplied with the first clock signal, the fourth input terminal is supplied with a first driving power source, and the fifth input terminal is supplied with a second driving power source, wherein the output circuit includes a fifth transistor, a sixth transistor, and a first capacitor, wherein the fifth transistor is connected between the fourth input terminal and the output terminal, and a gate electrode of the fifth transistor is connected to the first node, wherein the sixth transistor is connected between the output terminal and the third input terminal, and a gate electrode of the sixth transistor is connected to the second node, wherein the first capacitor is formed between the second node and the output terminal, wherein the second driving circuit includes a first transistor, seventh transistor, an eighth transistor, and a second capacitor, wherein the first transistor is connected between the third node and the second node, and a gate electrode of the first transistor is connected to the fifth input terminal, wherein the seventh transistor is connected between the first node and the second input terminal, and a gate electrode of the seventh transistor is connected to the third node, wherein the eighth transistor is connected between the first node and the fifth input terminal, and a gate electrode of the eight transistor is connected to the second input terminal, and wherein the second capacitor is formed between the fourth input terminal and the first node.

2. The display device according to claim 1, wherein the first clock signal, the second clock signal and the third clock signal have signal characteristics different from one another.

3. The display device according to claim 2, wherein the signal characteristics comprise at least one of a pulse width, a length of a rising edge period and a length of a falling edge period.

4. The display device according to claim 3, wherein the pulse width of the second clock signal is set to be smaller than the pulse width of the first clock signal and the pulse width of the third clock signal is set to be smaller than the pulse width of the first clock signal.

5. The display device according to claim 4, wherein the rising edge period of the second clock signal is set to be longer than the rising edge period of the first clock signal and the rising edge period of the third clock signal is set to be longer than the rising edge period of the first clock signal.

6. The display device according to claim 5, wherein the second clock signal and the third clock signal have a staircase wave form, and wherein the second clock signal and the third clock signal change from a low voltage to a high voltage via an intermediate voltage during the rising edge period.

7. The display device according to claim 4, wherein the falling edge period of the second clock signal is set to be longer than the falling edge period of the first clock signal and the falling edge period of the third clock signal is set to be longer than the falling edge period of the first clock signal.

8. The display device according to claim 7, wherein the second clock signal and the third clock signal have a staircase wave form, and wherein the second clock signal and the third clock signal change from a high voltage to a low voltage via an intermediate voltage during the falling edge period.

9. The display device according to claim 1, wherein the first driving circuit includes a second transistor, a third transistor, and a fourth transistor, wherein the second transistor is connected between the first input terminal and the third node, and a gate electrode of the second transistor is connected to the second input terminal, and wherein the third transistor and the fourth transistor is connected between the fourth input terminal and the third node in series, a gate electrode of the third transistor is connected to the third input terminal, and a gate electrode of the fourth transistor is connected to the first node.

* * * * *